US009944093B2

(12) United States Patent
Nakano et al.

(10) Patent No.: US 9,944,093 B2
(45) Date of Patent: Apr. 17, 2018

(54) RECORDING APPARATUS

(71) Applicant: SEIKO EPSON CORPORATION, Tokyo (JP)

(72) Inventors: Yosuke Nakano, Matsumoto (JP); Atsuhiko Takeuchi, Matsumoto (JP); Tomoko Shirai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/618,672

(22) Filed: Jun. 9, 2017

(65) Prior Publication Data

US 2017/0355202 A1 Dec. 14, 2017

(30) Foreign Application Priority Data

Jun. 14, 2016 (JP) ..... 2016-118134

(51) Int. Cl.
*B41J 11/00* (2006.01)
*B41J 29/13* (2006.01)

(52) U.S. Cl.
CPC ..... *B41J 11/0045* (2013.01); *B41J 29/13* (2013.01)

(58) Field of Classification Search
CPC ..... B41J 29/13; B41J 29/02; B41J 11/0045; B41J 15/04; B65H 31/04; B65H 2405/31
See application file for complete search history.

(56) References Cited

U.S. PATENT DOCUMENTS 6,991,331 B2 * 1/2006 Kagami ..... B41J 29/13 347/104

FOREIGN PATENT DOCUMENTS

JP 2014-034439 A 2/2014

* cited by examiner

*Primary Examiner* — Thinh H Nguyen
(74) *Attorney, Agent, or Firm* — Workman Nydegger

(57) ABSTRACT

A recording apparatus includes: a housing; a recording device that is provided inside the housing; a medium receiving tray moves between a first position and a second position, the first position being housed inside the housing, the second position being a position of protruding from the housing; a guide for guiding the medium receiving tray; and a guided portion of the medium receiving tray being guided by the guide, wherein the guide includes a first guide area and a second guide area, wherein the first guide area is guiding the guided portion from the first position to a third position that is located between the first position and the second position before the second position, wherein the second guide area is guiding the guided portion from the third position to the second position, and wherein the second guide area includes a narrowing area narrower than the first guide area.

6 Claims, 18 Drawing Sheets

RECORDING APPARATUS

CROSS REFERENCES TO RELATED APPLICATIONS

The entire disclosure of Japanese Patent Application No. 2016-118134, filed Jun. 14, 2016 is expressly incorporated by reference herein.

BACKGROUND

1. Technical Field

The present invention relates to a recording apparatus that performs recording on a medium.

2. Related Art

In related art, an ink-jet printer that is an example of a recording apparatus has the following structure. The printer is equipped with a medium receiving tray for receiving a medium ejected out of the body of the printer after recording. The medium receiving tray is driven by a motor for a position change between a housed position and a protruding position (see JP-A-2014-034439).

When the medium receiving tray protrudes from the body of the printer, the medium receiving tray is in a so-called cantilevered state. If an external force is applied to the medium receiving tray in this state, the medium receiving tray vibrates vertically. A user might feel uncomfortable about such vibration. Moreover, in a structure in which a medium receiving tray is driven by a motor, proper protrusion of the medium receiving tray is required.

SUMMARY

An advantage of some aspects of the invention is to put a medium receiving tray into a proper protrusion state.

A recording apparatus according to a first mode of the invention comprises: a housing; a recording device that is provided inside the housing and performs recording on a medium; a medium receiving tray that is able to move for a position change between a first position and a second position, the first position being a position of being housed inside the housing, the second position being a position of protruding from the housing to receive the medium ejected; a guide for guiding the medium receiving tray in a position change direction; and a guided portion of the medium receiving tray, the guided portion being guided by the guide, wherein the guide includes a first guide area and a second guide area, wherein the first guide area is an area for guiding the guided portion during movement of the medium receiving tray from the first position to a third position that is located between the first position and the second position before the second position, wherein the second guide area is an area for guiding the guided portion during movement of the medium receiving tray from the third position to the second position, and wherein the second guide area includes a narrowing area for making a movement path of an upstream portion and a downstream portion of the guided portion narrower than the movement path in the first guide area.

In this mode, the guide for guiding the guided portion of the medium receiving tray includes the first guide area and the second guide area, and the second guide area includes the narrowing area for making the movement path of the upstream portion and the downstream portion of the guided portion narrower than the movement path in the first guide area. The movement of the upstream portion and the downstream portion of the guided portion is restricted when the medium receiving tray is located in the second guide area. Therefore, it is possible to suppress the vibration of the medium receiving tray effectively.

In addition, since the movement path of the guided portion in the first guide area is not narrower than the movement path of the guided portion in the second guide area, a load against the movement of the guided portion is suppressed. Therefore, it is possible to cause the medium receiving tray to operate for a position change properly.

Moreover, since the second guide area includes an area for making the movement path of the upstream portion and the downstream portion of the guided portion narrower, it is unnecessary to uniformly make the movement path of the guided portion narrower in the entire second guide area. This makes it easier to obtain high molding precision and makes it possible to shorten the distance over which the guided portion receives a high load against the movement in the second guide area. A more detailed explanation will be given later with reference to the drawings.

In this specification, the term "upstream" of the guided portion means the upstream with respect to the direction of protruding movement of the medium receiving tray when the medium receiving tray changes its position from the first position toward the second position. The term "downstream" is the opposite of "upstream". Specifically, it means the downstream with respect to the direction of protruding movement of the medium receiving tray when the medium receiving tray changes its position from the first position toward the second position.

A second mode of the invention is that, in the first mode, movement of the upstream portion and the downstream portion of the guided portion in a direction of thickness of the medium receiving tray is restricted in the narrowing area.

In this mode, because of restriction on the movement of the upstream portion and the downstream portion of the guided portion in the direction of thickness of the medium receiving tray in the narrowing area, it is possible to suppress the vibration of the medium receiving tray more effectively.

A third mode of the invention is that, in the second mode, the upstream portion of the guided portion is thicker than the downstream portion of the guided portion; the second guide area has a shape for making the movement path of the guided portion narrower in a terraced manner as viewed from an upstream side toward a downstream side; and the movement path of the upstream portion and the downstream portion of the guided portion is made narrower due to the movement of the medium receiving tray from the third position toward the second position. With this mode, it is possible to form the second guide area with a simple structure at low cost.

A fourth mode of the invention is that, in any of the first, second, and third modes, the recording apparatus further comprises: a cassette that is a container for the medium and is able to be drawn out of the housing; wherein the cassette includes a cover that is able to be opened and closed and constitutes at least a part of front of the housing; and wherein the cover is urged in a closing direction and is able to be in contact with the medium receiving tray from below.

In this mode, the cassette, which is a container for the medium and is able to be drawn out of the housing, includes the cover that is able to be opened and closed and constitutes at least a part of front of the housing; wherein the cover is urged in a closing direction and is able to be in contact with the medium receiving tray from below. Because of the contact of the cover with the medium receiving tray, it is possible to further suppress the vibration of the medium receiving tray when external stress is applied to the medium receiving tray.

A fifth mode of the invention is that, in any of the first to fourth modes, the recording apparatus further comprises: a detector that detects protrusion of the medium receiving tray from the housing at the third position. In this mode, since the recording apparatus comprises the detector that detects protrusion of the medium receiving tray from the housing at the third position, it is possible to detect the protrusion of the medium receiving tray before the timing of the narrowing of the movement path of the guided portion when the medium receiving tray protrudes. The detection of the protrusion of the medium receiving tray makes it possible to continue the use of the recording apparatus even in a case where the guided portion is unable to move in the second guide area, that is, the area for narrowing the movement path of the guided portion, because of, for example, aged deterioration of the guide or the deformation of the guided portion.

A recording apparatus according to a sixth mode of the invention comprises: a housing; a recording device that is provided inside the housing and performs recording on a medium; a medium receiving tray that is able to move for a position change between a first position and a second position, the first position being a position of being housed inside the housing, the second position being a position of protruding from the housing to receive the medium ejected; a guide for guiding the medium receiving tray in a position change direction; and a guided portion of the medium receiving tray, the guided portion being guided by the guide, wherein the guide includes a first guide area and a second guide area, wherein the first guide area is an area for guiding the guided portion during movement of the medium receiving tray from the first position to a third position that is located between the first position and the second position before the second position, wherein the second guide area is an area for guiding the guided portion during movement of the medium receiving tray from the third position to the second position, and wherein the second guide area includes a narrowing area for making a movement path of an upstream portion and a downstream portion of the guided portion narrower than the movement path in the first guide area.

In this mode, the guide for guiding the guided portion of the medium receiving tray includes the first guide area and the second guide area, and the second guide area includes the narrowing area for making the movement path of the guided portion narrower than the movement path in the first guide area. The movement of the guided portion is restricted when the medium receiving tray is located in the second guide area. Therefore, it is possible to suppress the vibration of the medium receiving tray. In addition, since the movement path of the guided portion in the first guide area is not narrower than the movement path of the guided portion in the second guide area, a load against the movement of the guided portion is suppressed. Therefore, it is possible to cause the medium receiving tray to operate for a position change properly.

Moreover, since the recording apparatus comprises the detector that detects protrusion of the medium receiving tray from the housing at the third position, it is possible to detect the protrusion of the medium receiving tray before the timing of the narrowing of the movement path of the guided portion when the medium receiving tray protrudes. The detection of the protrusion of the medium receiving tray makes it possible to continue the use of the recording apparatus even in a case where the guided portion is unable to move in the second guide area, that is, the area for narrowing the movement path of the guided portion, because of, for example, aged deterioration of the guide or the deformation of the guided portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
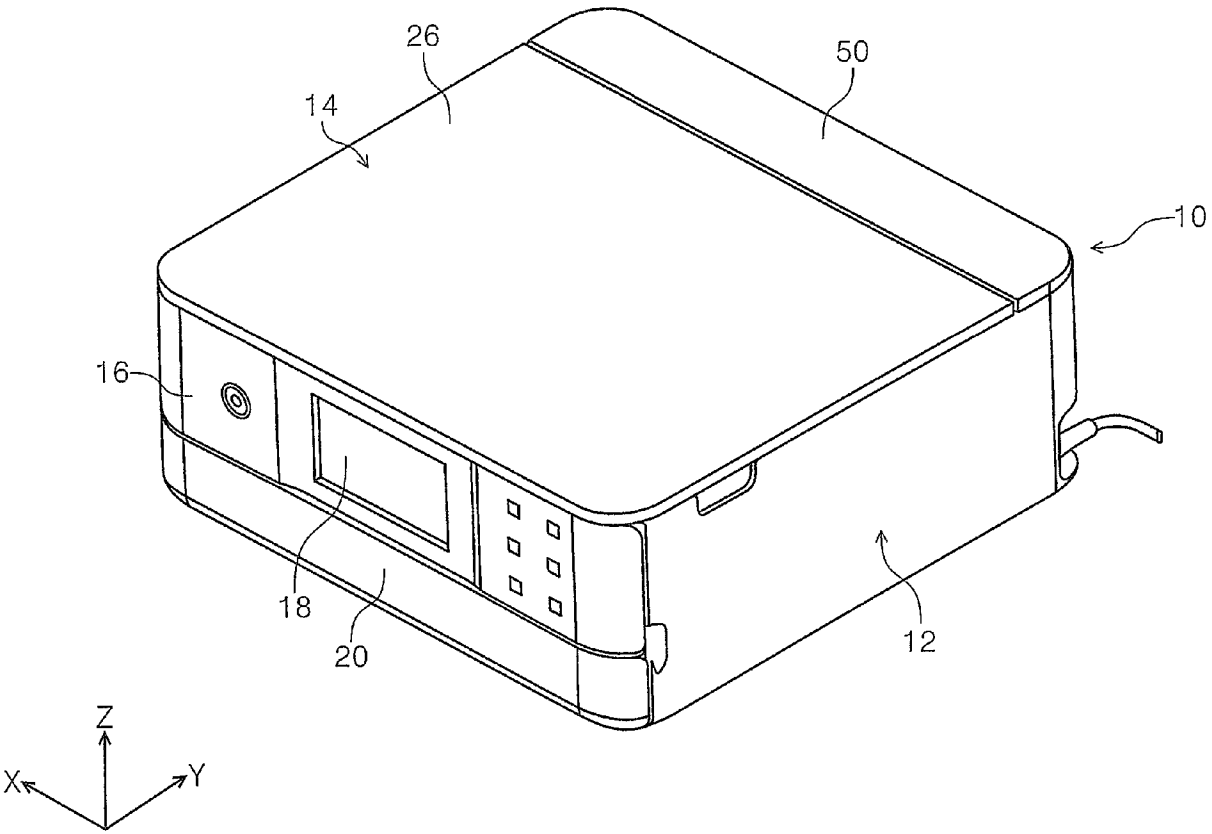
FIG. 1 is an external perspective view of a printer according to an embodiment of the invention.

With reference to the accompanying drawings, exemplary embodiments of the present invention will now be explained. In each embodiment, the same reference numerals are assigned to the same components, and they are explained in the first embodiment only. An explanation of them is omitted in the subsequent embodiments.

Figure 2:
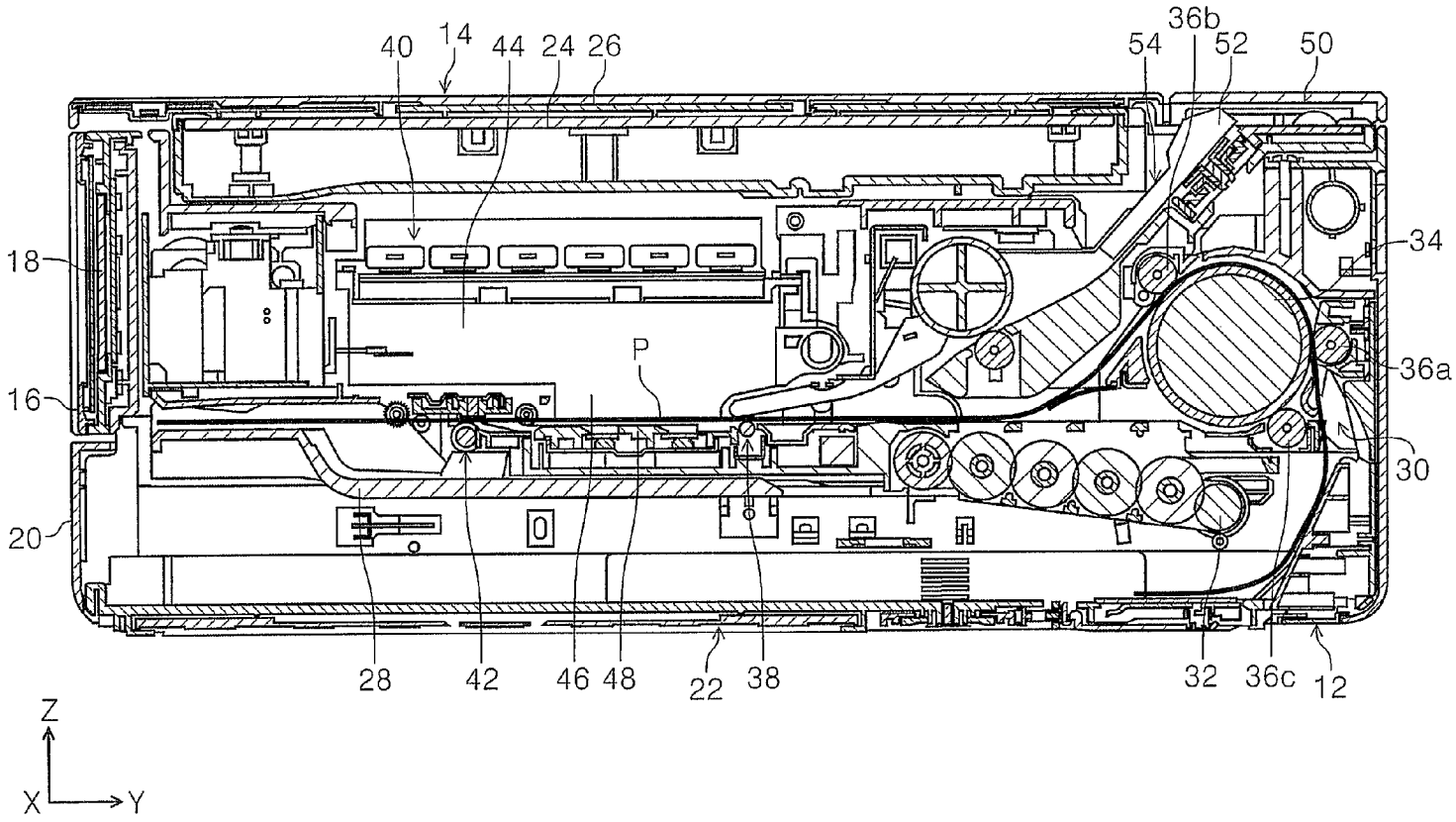
FIG. 2 is a side sectional view of a medium transportation path in a printer according to an embodiment of the invention.
Figure 3:
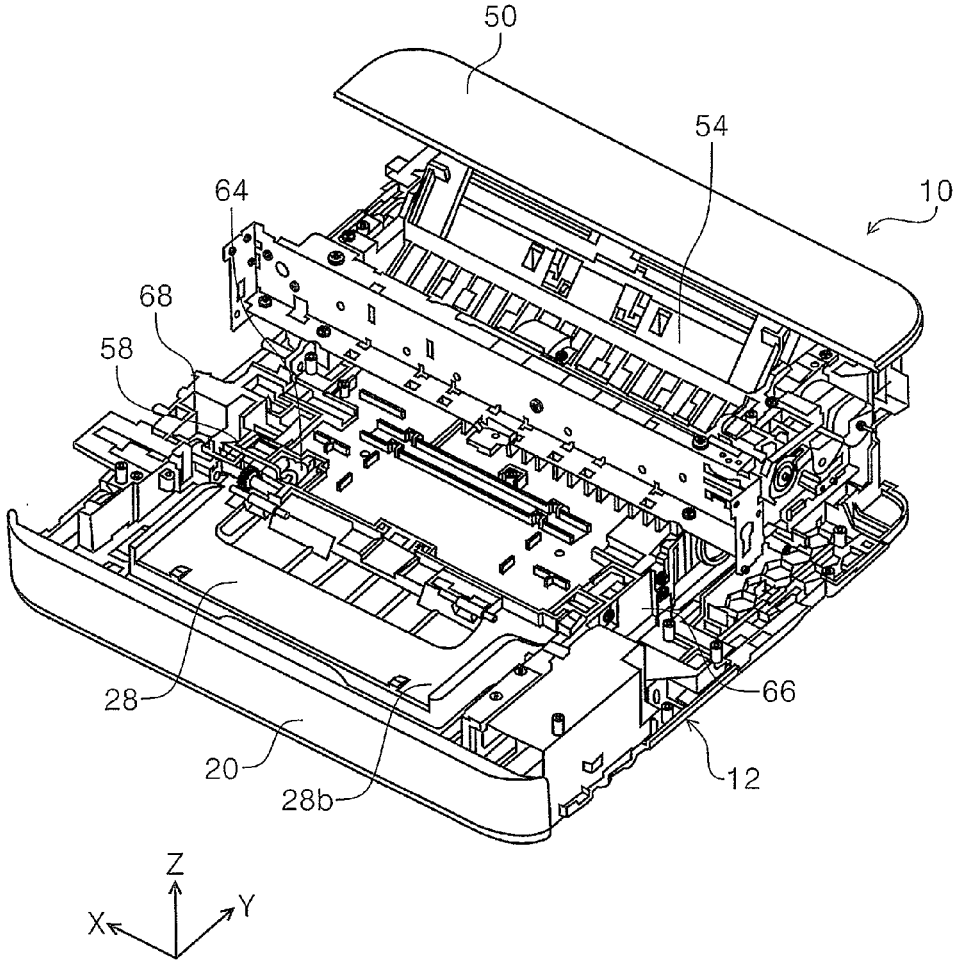
FIG. 3 is a perspective view of a state in which a medium receiving tray of a printer according to an embodiment of the invention is located at a first position.
Figure 4:
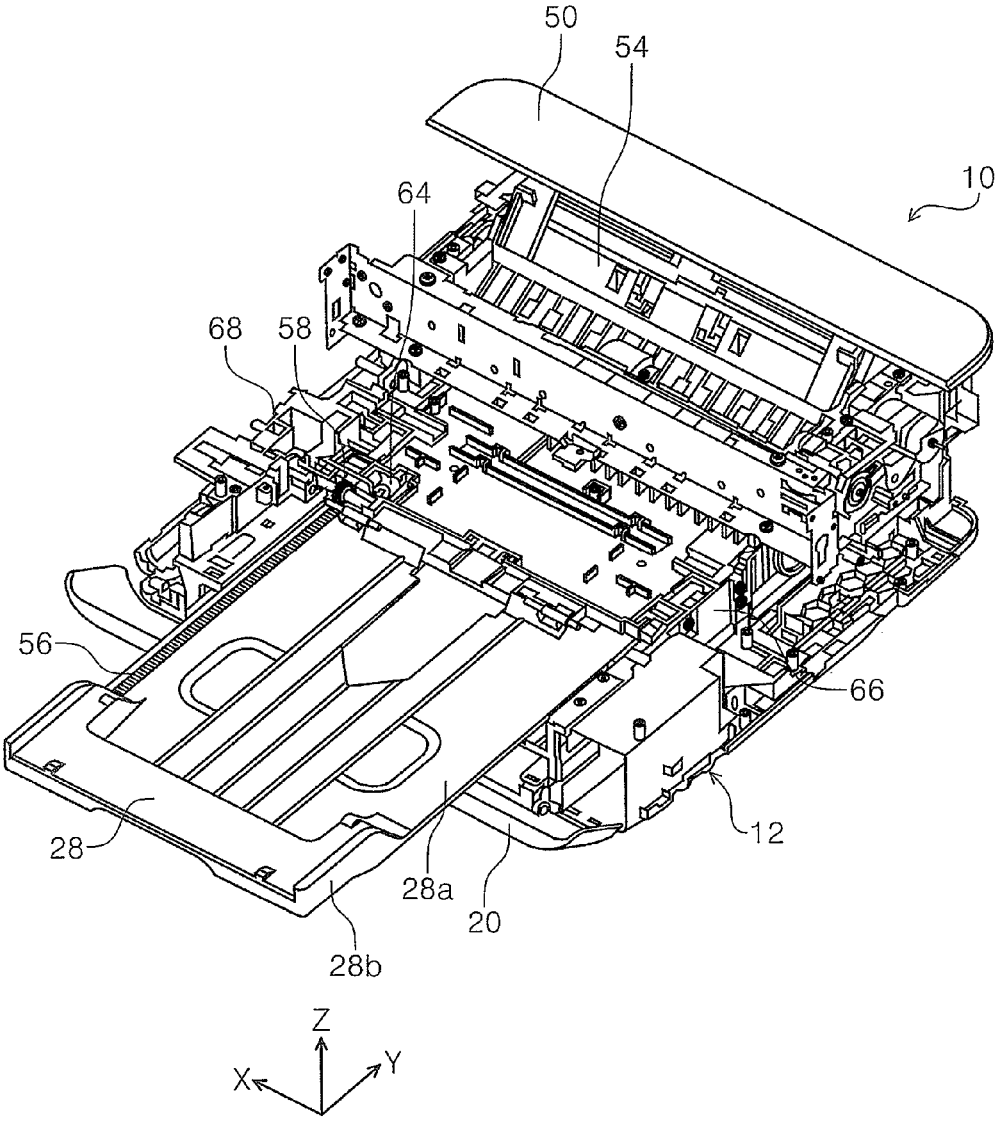
FIG. 4 is a perspective view of a state after a position change of the medium receiving tray of the printer from the first position to a second position.
Figure 5:
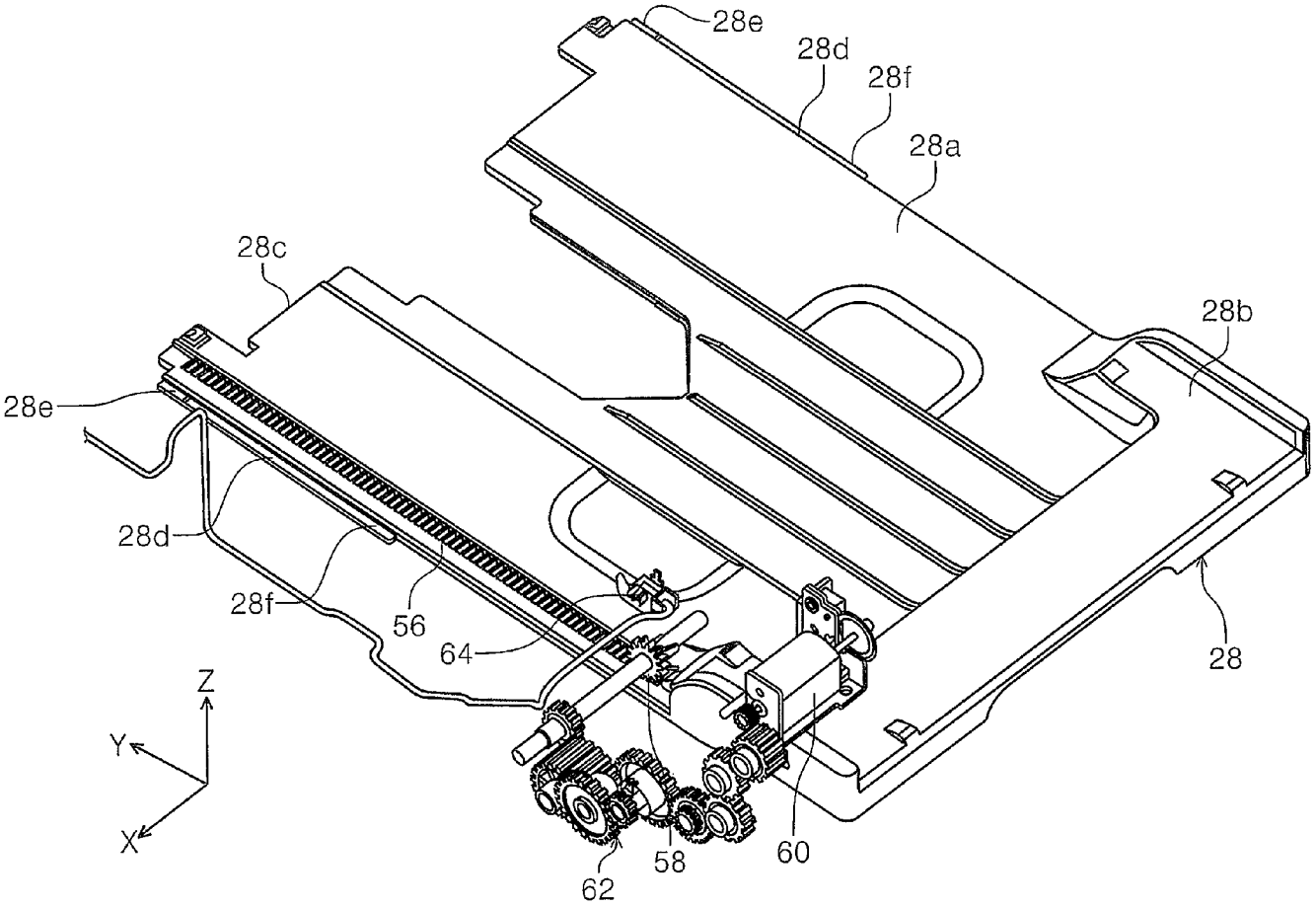
FIG. 5 is a perspective view of a medium receiving tray according to an embodiment of the invention.
Figure 6:
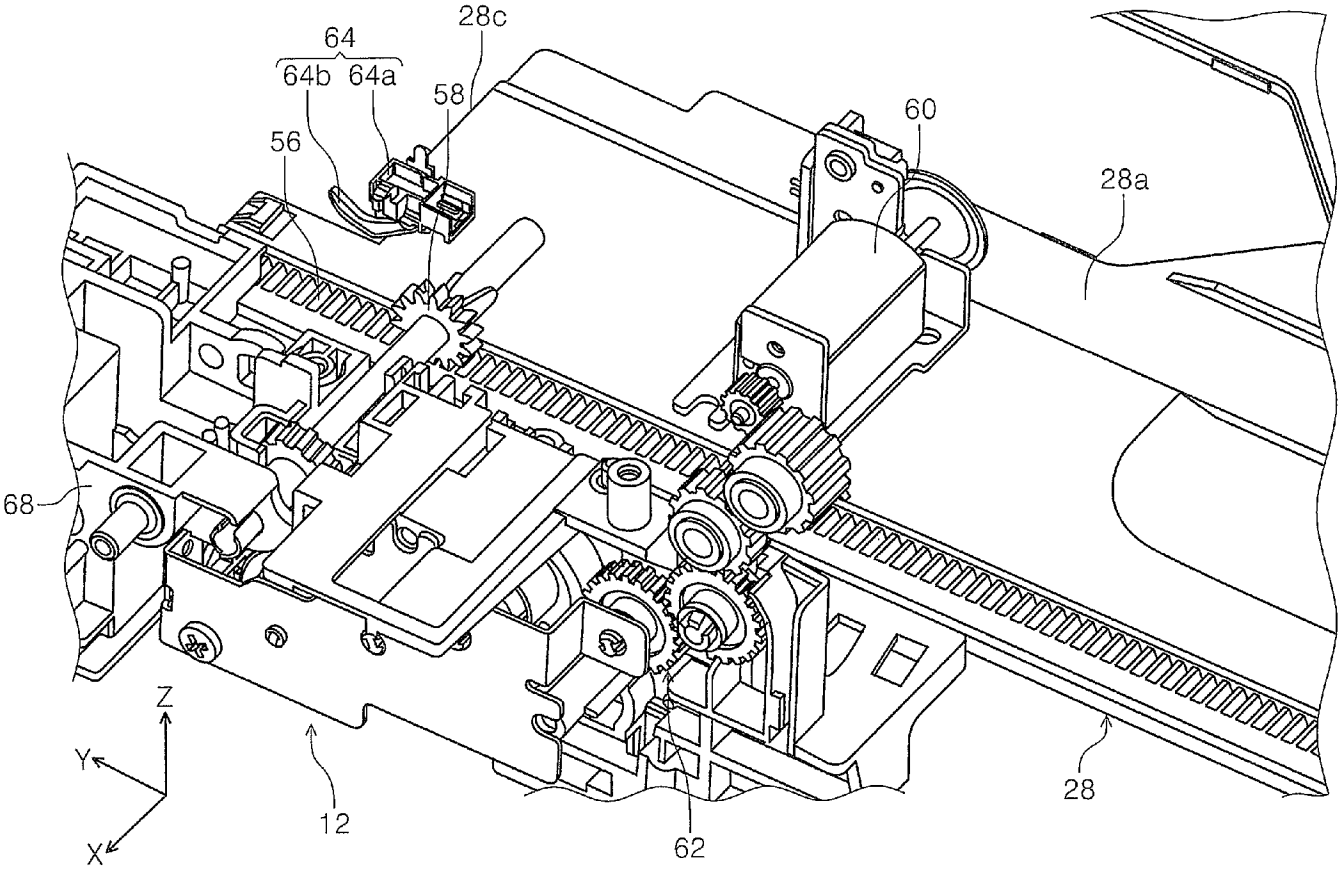
FIG. 6 is a perspective view of a detector that detects the position of the medium receiving tray.

FIG. 1 is an external perspective view of a printer according to an embodiment of the invention. FIG. 2 is a side sectional view of a medium transportation path in a printer according to an embodiment of the invention. FIG. 3 is a perspective view of a state in which a medium receiving tray of a printer according to an embodiment of the invention is located at a first position. FIG. 4 is a perspective view of a state after a position change of the medium receiving tray of the printer from the first position to a second position. FIG. 5 is a perspective view of a medium receiving tray according to an embodiment of the invention. FIG. 6 is a perspective view of a detector that detects the position of the medium receiving tray.

Figure 7:
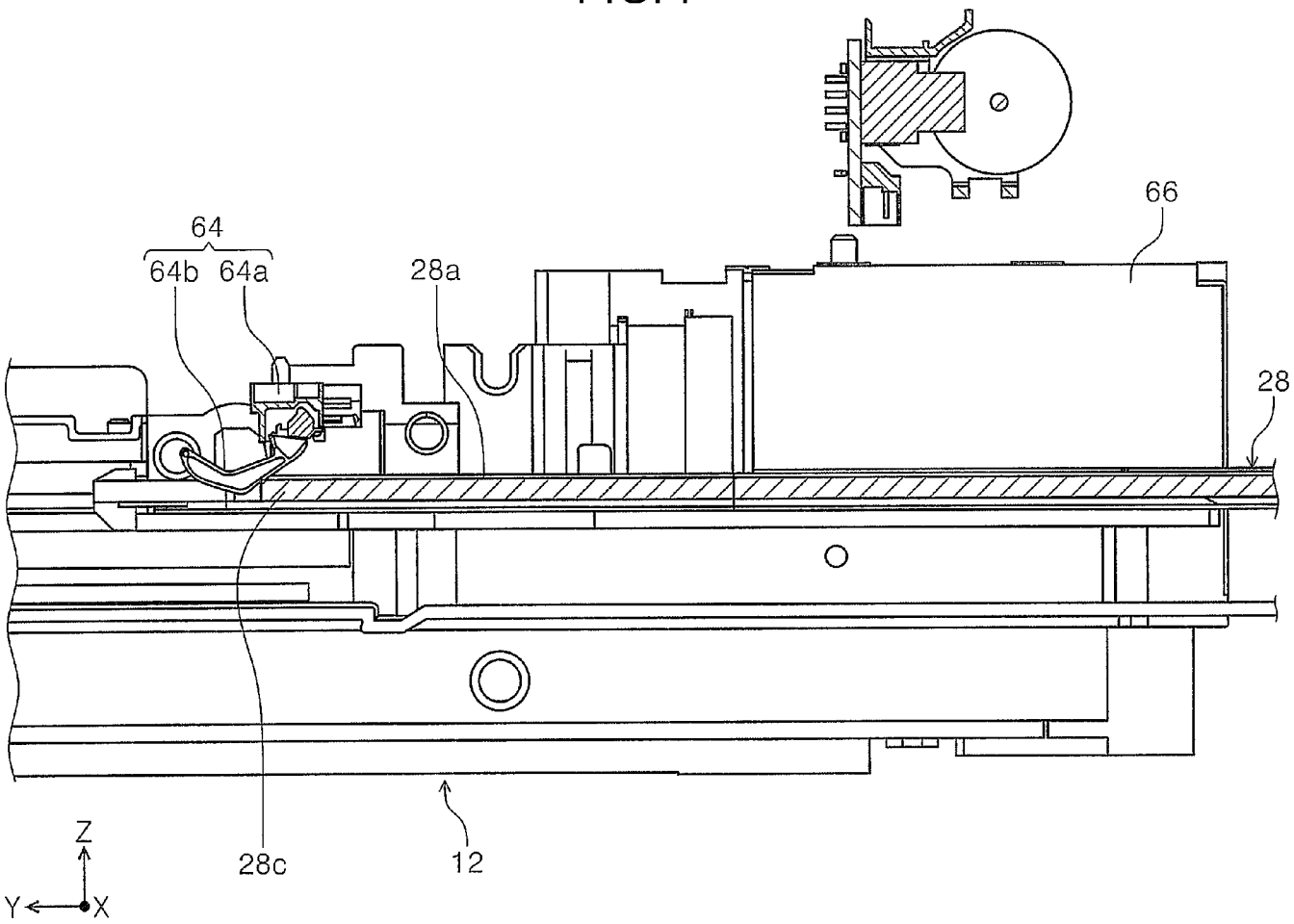
FIG. 7 is a side view of a state of detection of a third position of the medium receiving tray by the detector.
Figure 8:
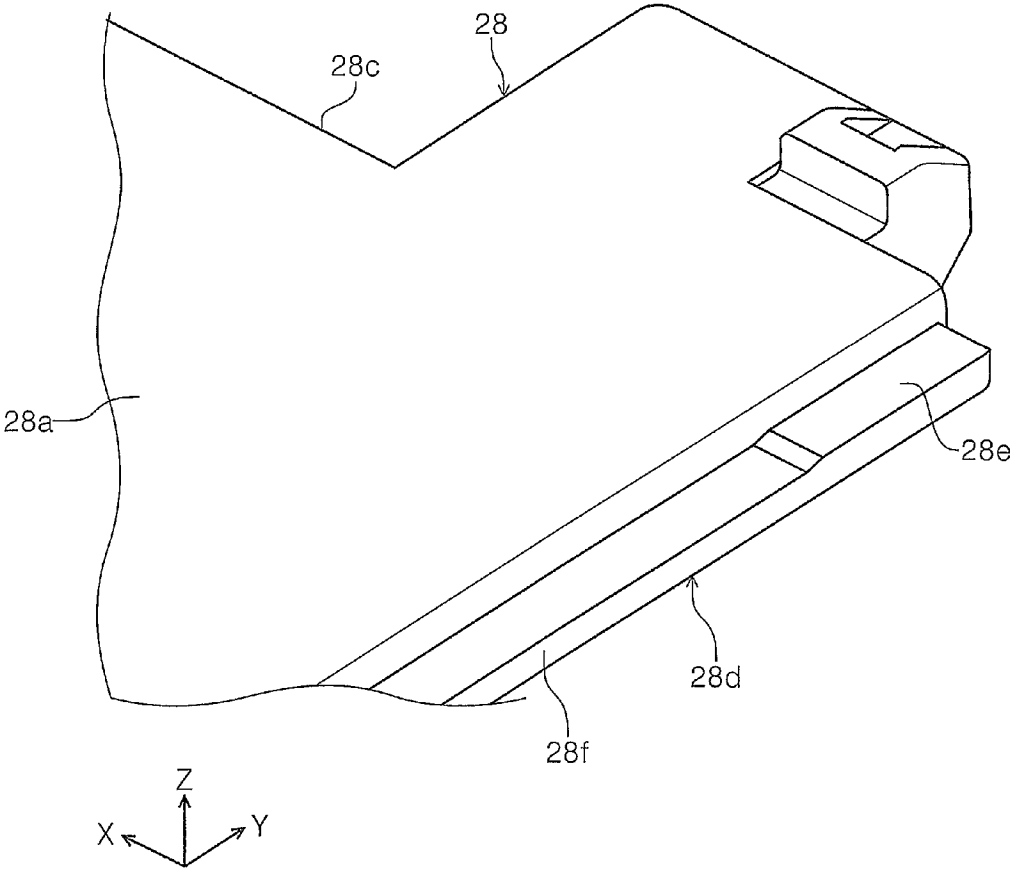
FIG. 8 is a perspective view of a guided portion of the medium receiving tray.
Figure 9:
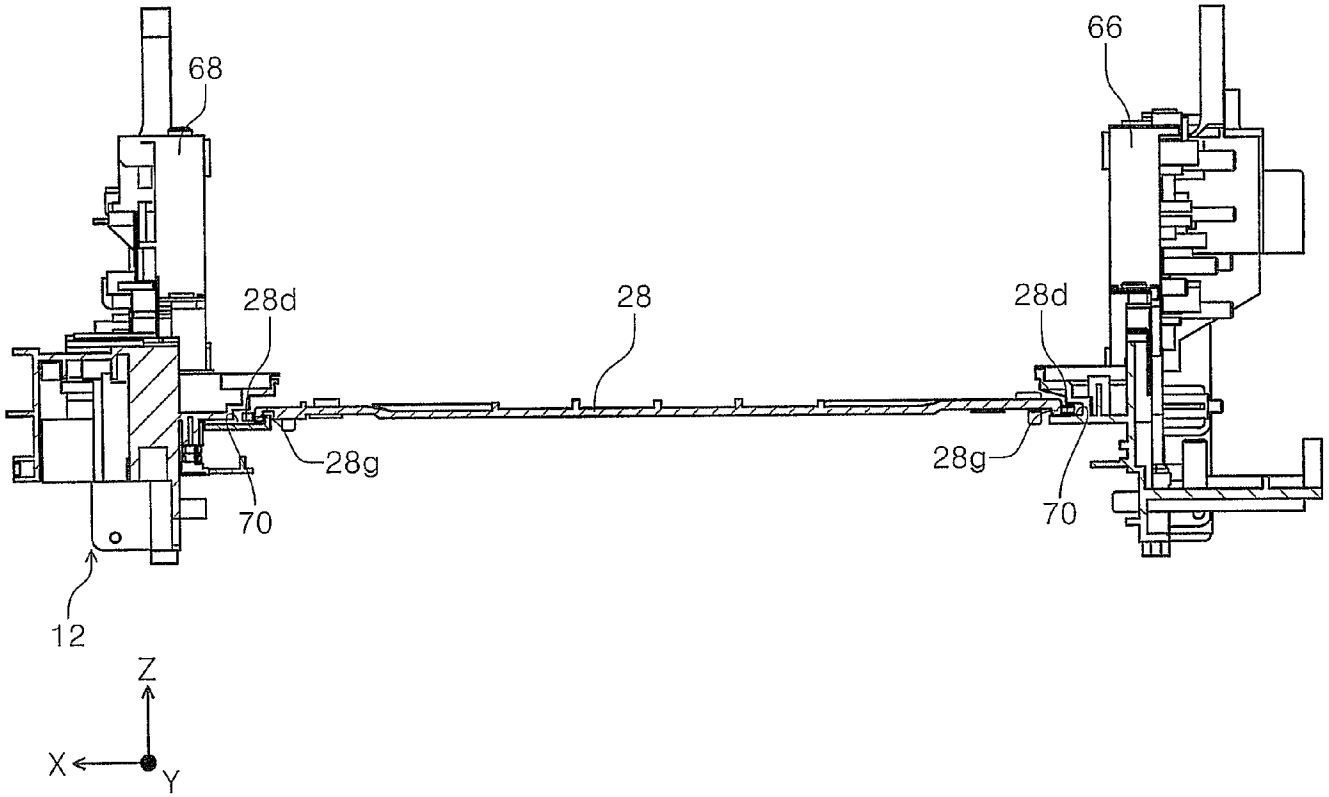
FIG. 9 is a sectional view of a state in which the medium receiving tray is attached to a case.
Figure 10:
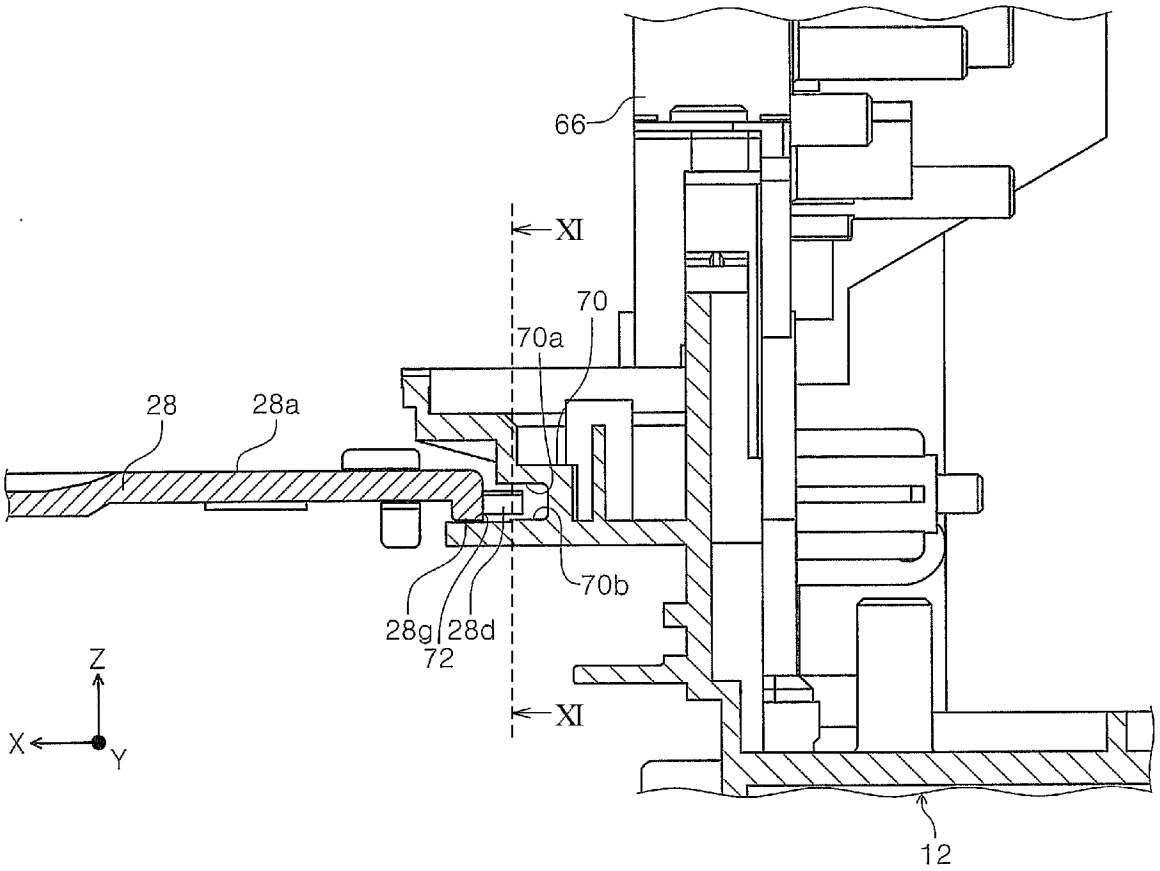
FIG. 10 is a sectional view illustrating a relationship between the guided portion of the medium receiving tray and a guide of the case.
Figure 11:
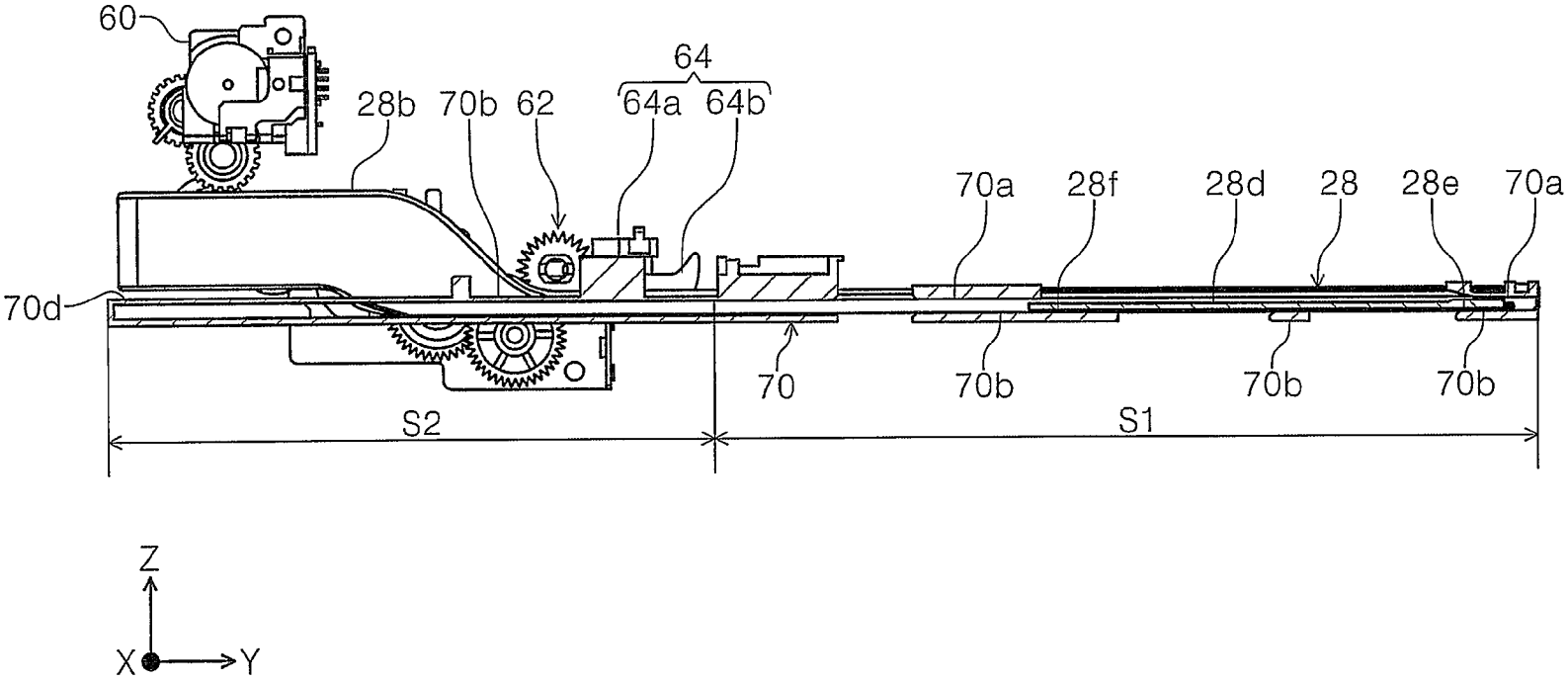
FIG. 11 is a sectional view taken along the line XI-XI of FIG. 10.
Figure 12:
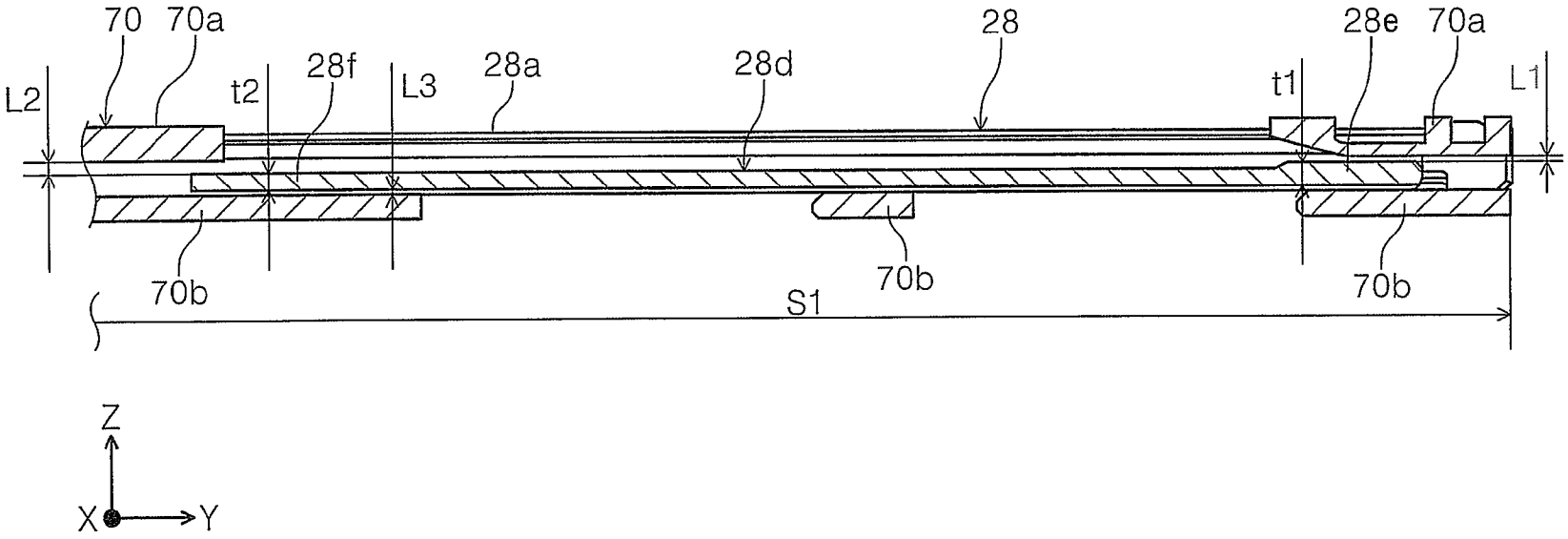
FIG. 12 is a side sectional view illustrating a relationship between the guide and the guided portion in a state in which the medium receiving tray is located at the first position.

FIG. 7 is a side view of a state of detection of a third position of the medium receiving tray by the detector. FIG. 8 is a perspective view of a guided portion of the medium receiving tray. FIG. 9 is a sectional view of a state in which the medium receiving tray is attached to a case. FIG. 10 is a sectional view illustrating a relationship between the guided portion of the medium receiving tray and a guide of the case. FIG. 11 is a sectional view taken along the line XI-XI of FIG. 10. FIG. 12 is a side sectional view illustrating a relationship between the guide and the guided portion in a state in which the medium receiving tray is located at the first position.

Figure 13:
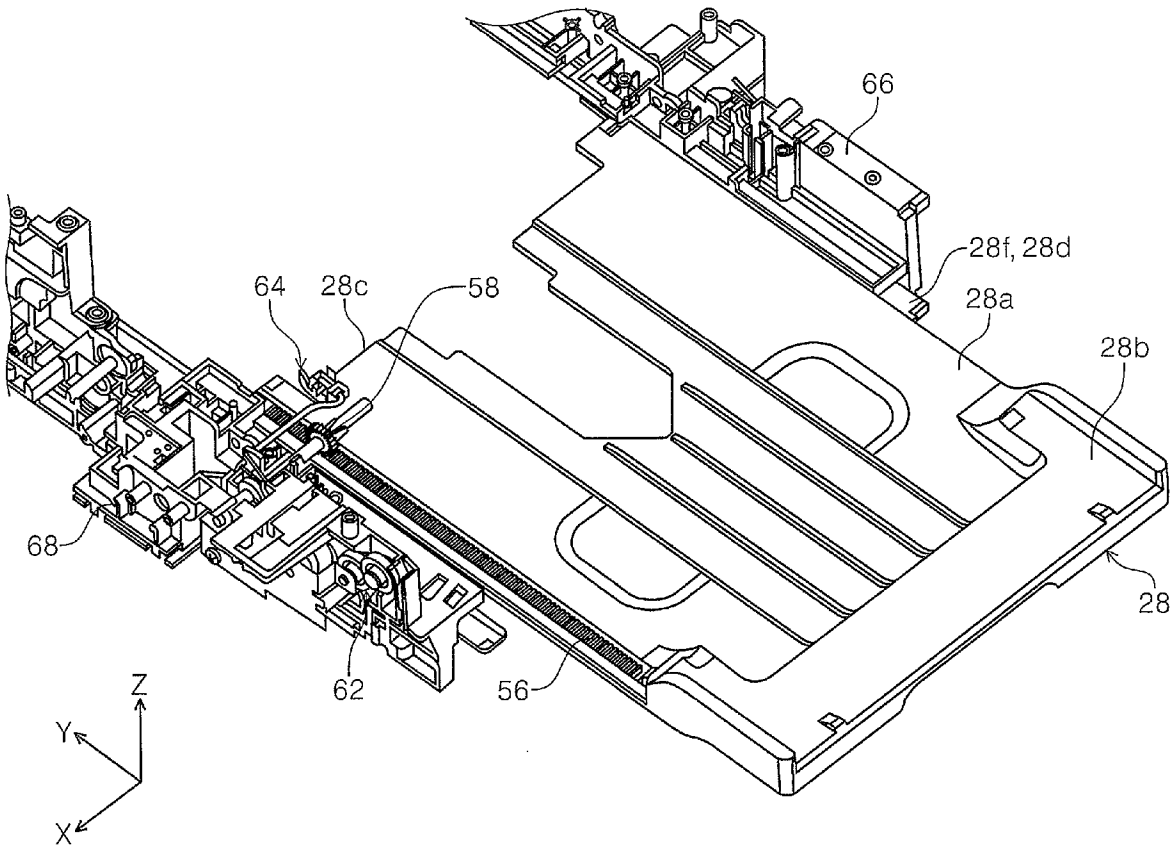
FIG. 13 is a perspective view of a state in which the medium receiving tray is located at the third position.
Figure 14:
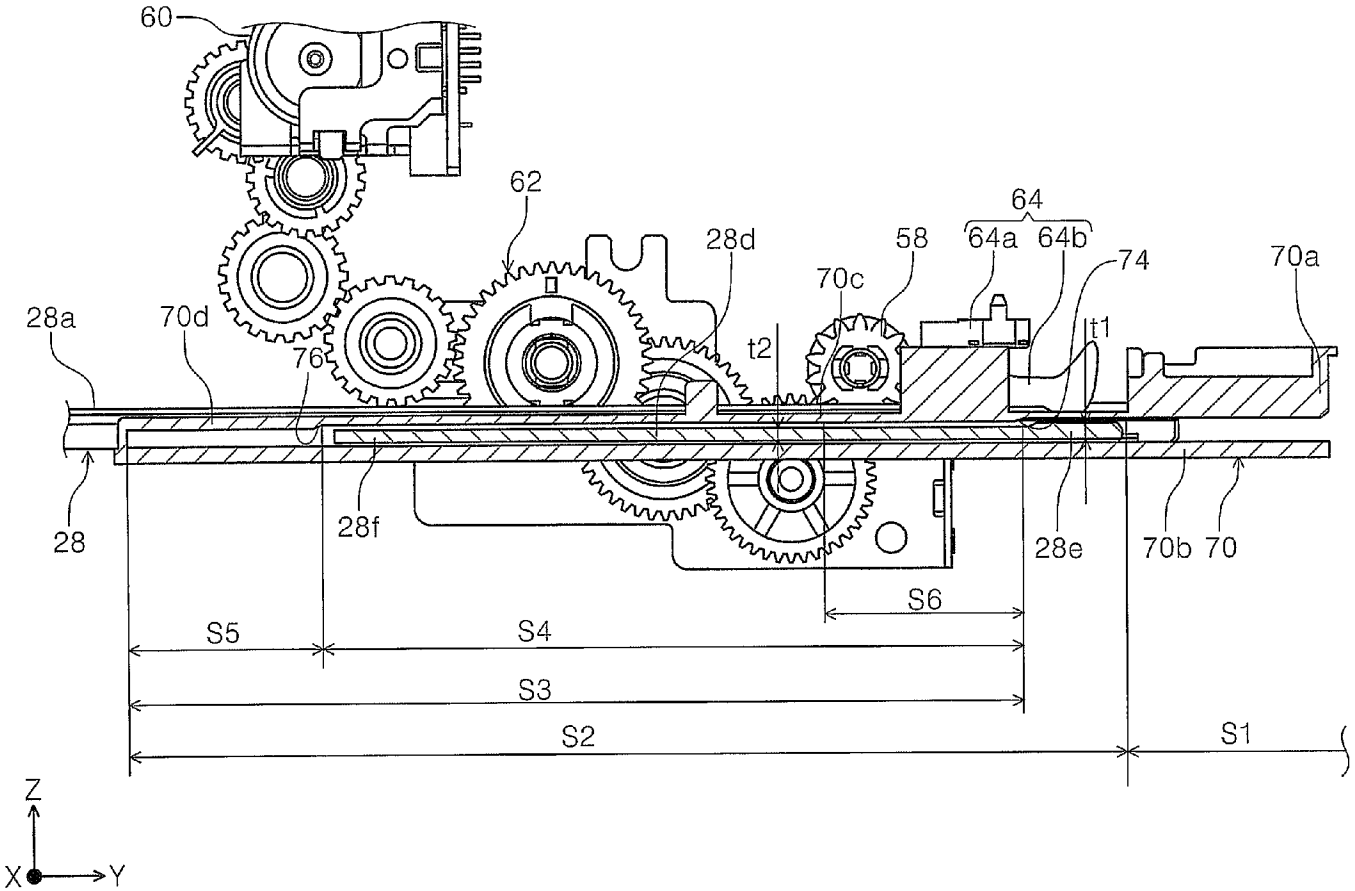
FIG. 14 is a side sectional view illustrating a relationship between the guide and the guided portion in a state in which the medium receiving tray is located at the third position.
Figure 15:
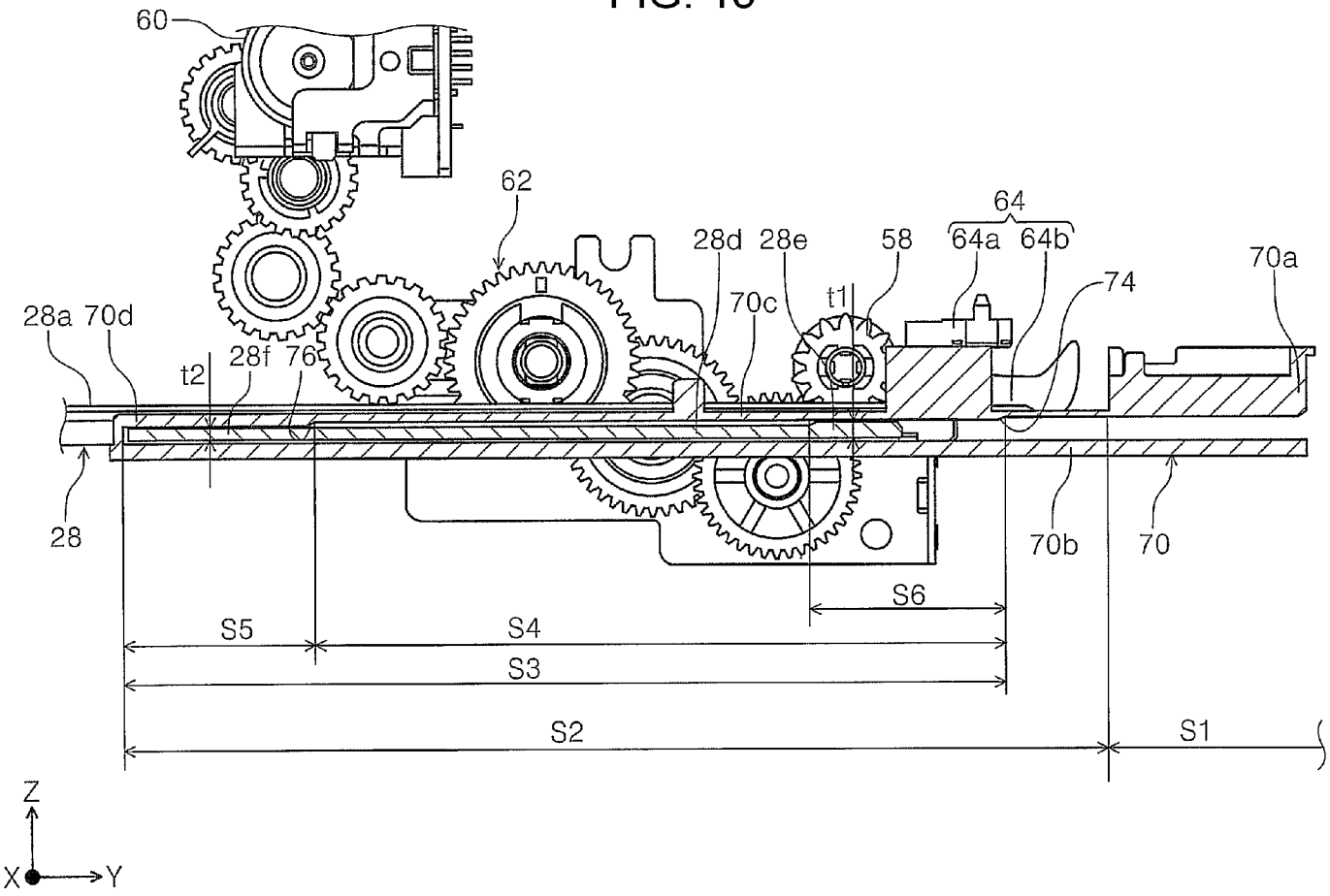
FIG. 15 is a side sectional view illustrating a relationship between the guide and the guided portion in a state in which the medium receiving tray is located at the second position.
Figure 16:
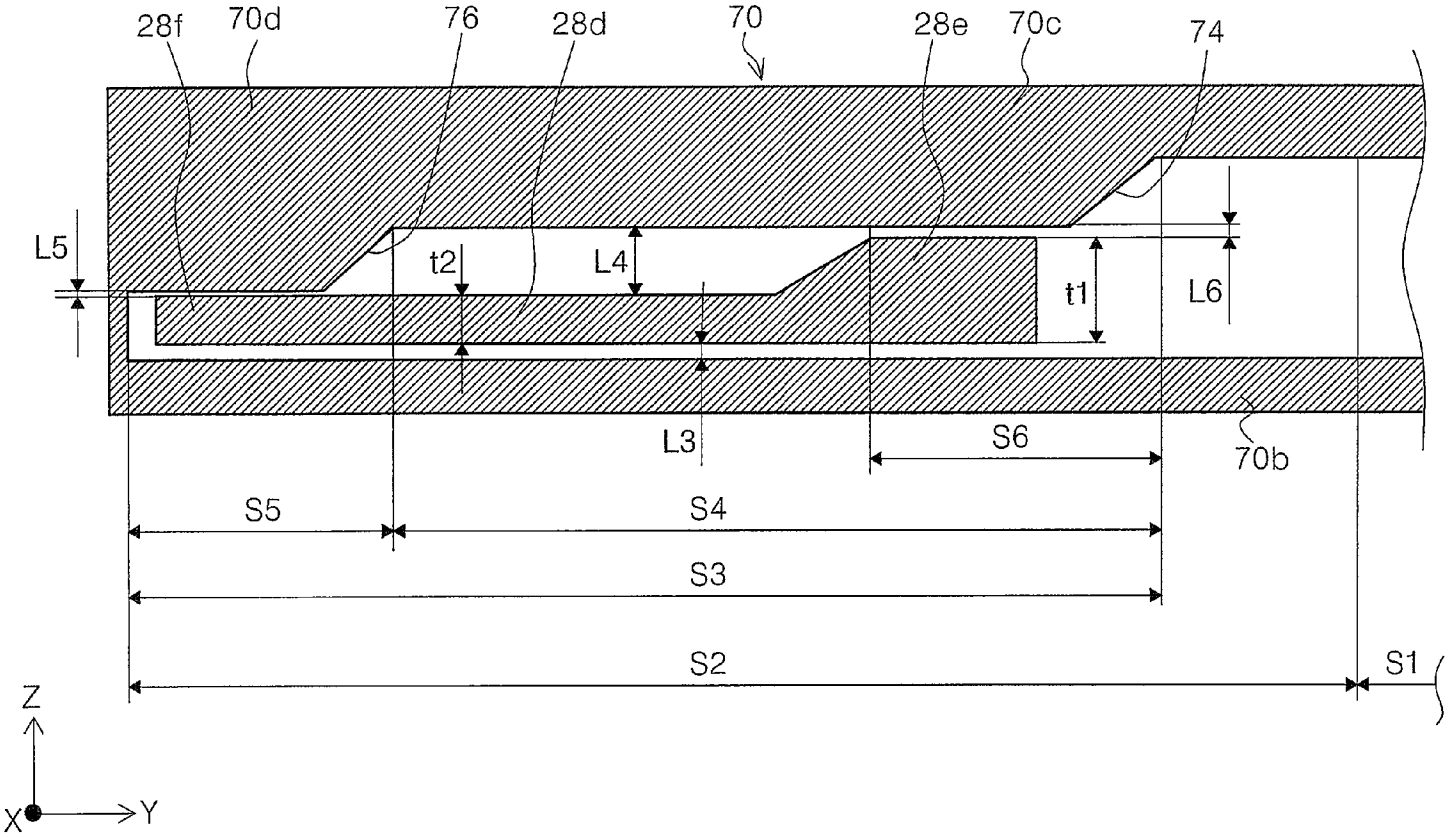
FIG. 16 is a schematic view for explaining a relationship between the guide and the guided portion in a state in which the medium receiving tray is located at the second position.
Figure 17:
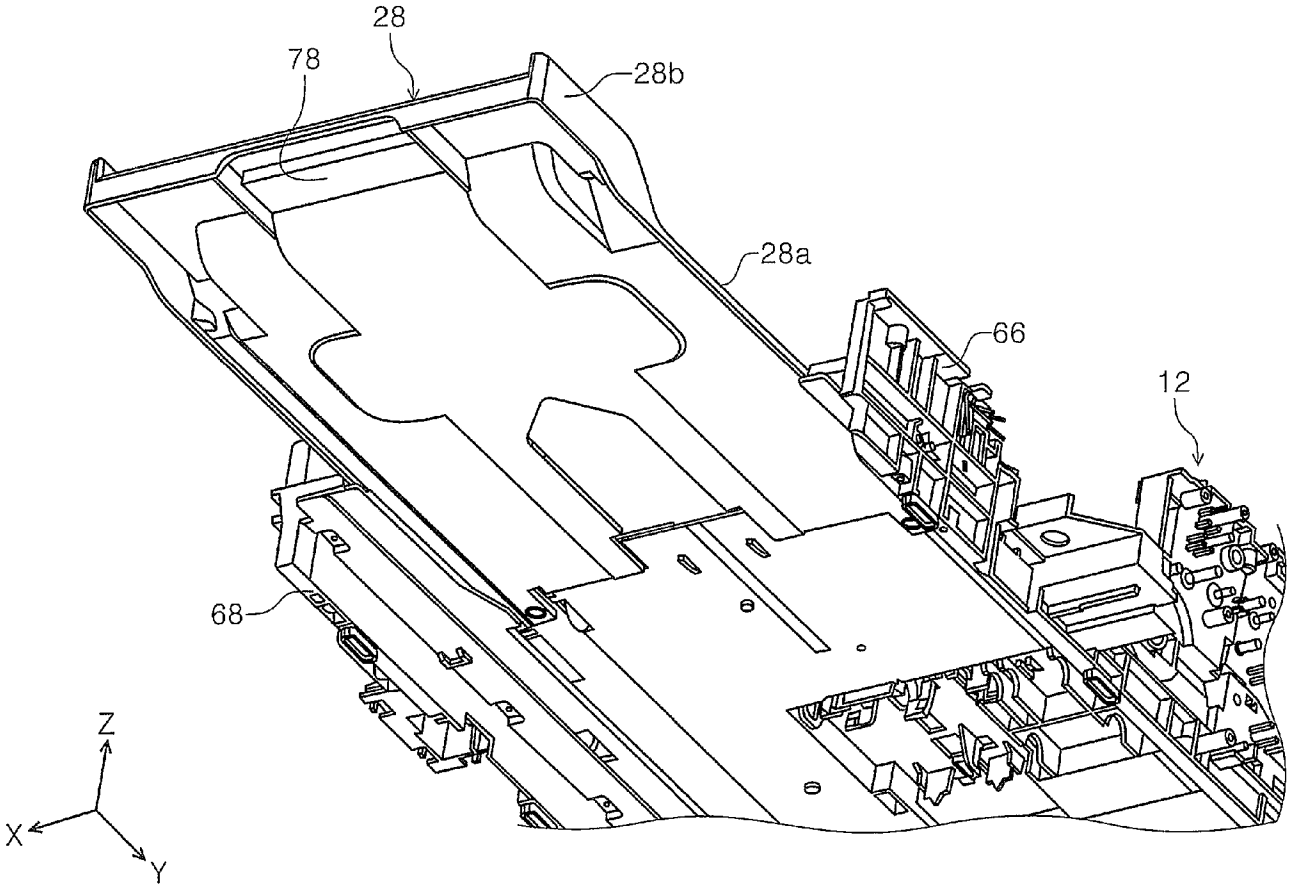
FIG. 17 is a perspective view of a second embodiment.
Figure 18:
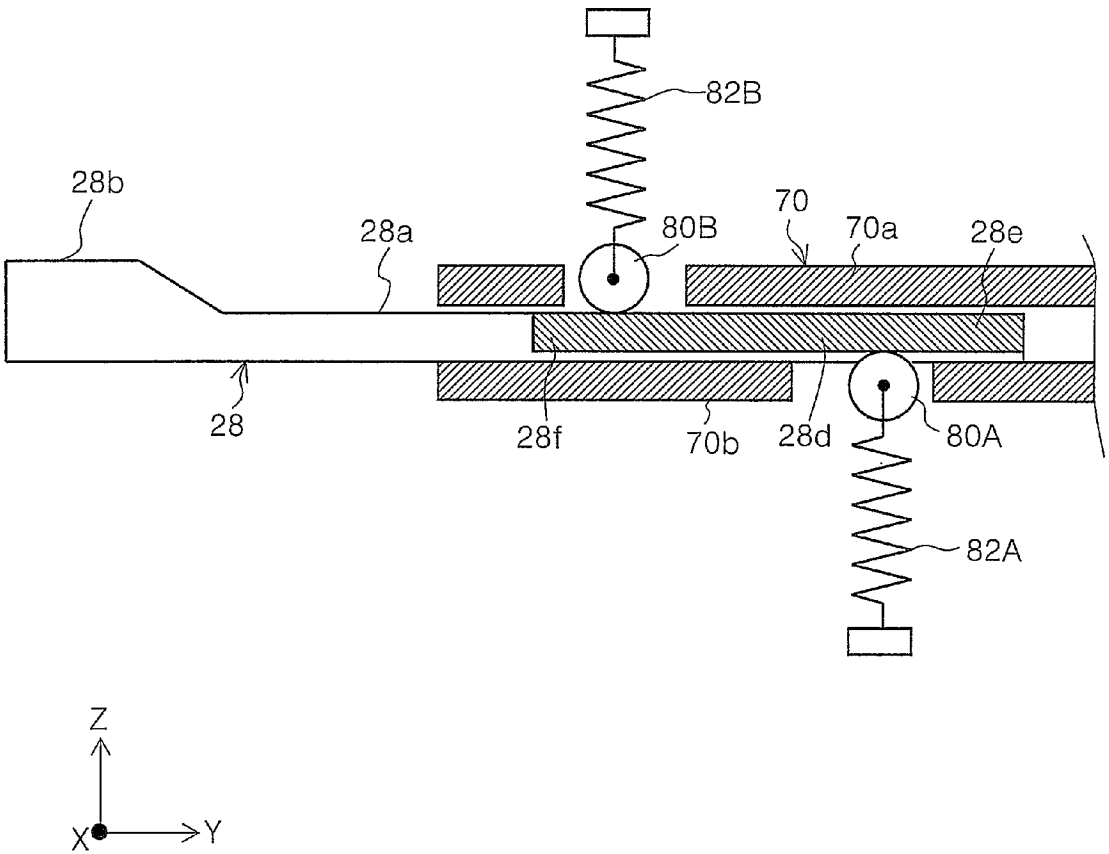
FIG. 18 is a side sectional view of a third embodiment.

FIG. 13 is a perspective view of a state in which the medium receiving tray is located at the third position. FIG. 14 is a side sectional view illustrating a relationship between the guide and the guided portion in a state in which the medium receiving tray is located at the third position. FIG. 15 is a side sectional view illustrating a relationship between the guide and the guided portion in a state in which the medium receiving tray is located at the second position. FIG. 16 is a schematic view for explaining a relationship between the guide and the guided portion in a state in which the medium receiving tray is located at the second position. FIG. 17 is a perspective view of a second embodiment. FIG. 18 is a side sectional view of a third embodiment.

The X-Y-Z coordinate system shown in each of the accompanying drawings is defined as follows. The X direction represents the main scan direction (movement direction) of a carriage, that is, the direction of the width of the recording apparatus. The Y direction represents the direction in which the medium is transported, that is, the direction of the depth of the recording apparatus. The Z direction represents the direction of the height of the recording apparatus. In each of the accompanying drawings, the +X directional side corresponds to the left-hand side of the apparatus, and the −X directional side corresponds to the right-hand side of the apparatus. The +Y direction corresponds to the direction toward the rear of the apparatus, and the −Y direction corresponds to the direction toward the front of the apparatus. Similarly, the +Z direction corresponds to the direction toward the top of the apparatus, and the −Z direction corresponds to the direction toward the bottom of the apparatus.

First Embodiment

Overview of Printer

As illustrated in FIG. 1, a printer 10 includes a case 12 and a scanner unit 14 provided on the top of the case 12. An operation unit 16 is provided on the front of the case 12 rotatably (in a tiltable manner) in relation to the case 12. More specifically, the operation unit 16 is able to switch between a closed position, which is the position of being closed in relation to the case 12 (see FIG. 1), and a rotated position, which is the position of being rotated frontward in relation to the case 12 (not illustrated). A display 18 such as a display panel is provided on the operation unit 16.

A cover 20 is provided on the front of the case 12 under the operation unit 16. The cover 20 is mounted in front of a cassette 22 (see FIG. 2) rotatably in relation to the cassette 22. The cassette 22 is a medium container. The cover 20 is urged in a direction of being closed toward the cassette 22 by an urging member that is not illustrated. The cassette 22 is inserted through the front of the case 12 for detachable attachment into the case 12. As illustrated in FIG. 1, the cassette 22 attached to the case 12 constitutes at least a part of the front of the case 12.

As illustrated in FIGS. 1 and 2, the scanner unit 14 includes a document table 24. The scanner unit 14 further includes a document table cover 26. For example, the document table 24 is made of a transparent glass plate, on the top of which a document can be placed. The document table cover 26 is rotatable in relation to the document table 24, and is able to switch between a closed position, which is the position of hiding the document table 24 (see FIG. 1), and an open position, which is the position of exposing the document table 24.

A user rotates the document table cover 26 in relation to the document table 24 to put it into an open state. In this state, the document table 24 is exposed. The user sets a document on the exposed top surface, and closes the document table cover 26. In this state, the document set on the document table 24 is able to be scanned.

A medium receiving tray 28 is provided inside the case 12. The medium receiving tray 28 is able to switch between a state of being housed inside the case 12 as illustrated in FIG. 3 and a state of being ejected frontward as illustrated in FIG. 4. The structure and operation of the medium receiving tray 28 will be described in detail later.

Medium Transportation Path

Next, with reference to FIG. 2, a medium transportation path 30 provided in the case 12 will now be explained. In FIG. 2, the thick solid line denoted as P represents a medium transportation path 30 along which a guided medium is transported from the cassette 22 to the medium receiving tray 28.

A pickup roller 32, a feeder roller 34, driven rollers 36*a*, 36*b*, and 36*c*, a pair of transportation rollers 38, a recording unit 40, and a pair of eject rollers 42 are provided in this order along the medium transportation path 30 inside the case 12. The medium contained in the cassette 22 is picked up by the pickup roller 32 and is transported toward the feeder roller 34, which is provided downstream of the pickup roller 32, along the medium transportation path 30. Then, the medium is nipped by the feeder roller 34 and the driven roller 36*a* and next by the feeder roller 34 and the driven roller 36*b* to be transported toward the pair of transportation rollers 38. The medium is transported by the pair of transportation rollers 38 toward the recording unit 40.

The recording unit 40 includes a carriage 44, a recording head 46, and a medium supporting member 48. The recording head 46, which is an example of a "recording device", is mounted on the bottom of the carriage 44. The carriage 44 is able to reciprocate in the direction of the width of the case 12. The recording head 46 ejects ink downward in the printer height direction.

The medium supporting member 48 is provided under the recording head 46 at an area facing the recording head 46. The medium supporting member 48 supports the back (the reverse surface that is the opposite of the recording target surface) of the sheet of the medium having been transported to the area facing the recording head 46 by the pair of transportation rollers 38. The recording head 46 ejects ink onto the medium, the back of which is supported by the medium supporting member 48, thereby printing an image on the recording target surface of the medium.

After the recording, the medium is nipped by the pair of eject rollers 42, which is provided downstream of the recording unit 40 in the transportation direction. Then, the medium is ejected onto the medium receiving tray 28 protruding frontward (see FIG. 4).

As illustrated in FIGS. 1 and 2, a top cover 50 is attached rotatably to the case 12 at the rear top region of the case 12. When the top cover 50 is opened, a setting opening 52 becomes exposed. A medium inserted into the exposed setting opening 52 is transported toward the recording unit 40 while being guided along a medium guiding path 54. The recording unit 40 performs recording on the medium. After the recording, the medium is ejected onto the medium receiving tray 28.

In a case of double-sided printing, recording is to be performed on the second side (back) of the medium, which is the opposite of the first side (recording target surface), after recording onto the first side of the medium by the recording unit 40. In such a case, the pair of transportation rollers 38 is rotated in the reverse direction so as to transport the medium toward the upstream side in the transportation direction. The medium transported to the upstream side in the transportation direction is nipped by the feeder roller 34 and the driven roller 36*c*. The medium is turned over by the feeder roller 34 for reversal of the first side and the second side, and is transported toward the recording unit 40 again. After recording onto the second side of the medium by the recording unit 40, the medium is ejected onto the medium receiving tray 28.

Medium Receiving Tray

Next, with reference to FIGS. 3 to 15, the structure and operation of the medium receiving tray 28 will now be explained. The medium receiving tray 28 is able to switch between a state of being housed inside the case 12 as illustrated in FIG. 3 and a state of protruding frontward beyond the front of the case 12 as illustrated in FIG. 4. More specifically, the medium receiving tray 28 is able to move between a first position and a second position in the printer depth direction, wherein the first position is defined as a position of being housed inside the case 12 as illustrated in FIG. 3, and wherein the second position is defined as a position of protruding frontward beyond the front of the case 12 as illustrated in FIG. 4 so as to receive a medium.

As illustrated in FIG. 5, the medium receiving tray 28 includes a flat plate portion 28*a* and a raised portion 28*b*. The flat plate portion 28*a* has a plate shape. The raised portion 28*b* is a front portion in the printer depth direction in relation to the flat plate portion 28*a*. The raised portion 28*b* is elevated in relation to the flat plate portion 28*a* in the printer height direction. The medium transported from the recording unit 40 is received by the flat plate portion 28*a* and the raised portion 28*b* of the medium receiving tray 28. Regarding the direction mentioned in the description of the portions of the medium receiving tray 28, the direction in a state in which the medium receiving tray 28 is attached to the case 12 is considered.

The flat plate portion 28*a* has a rack 56 that is elongated in the printer depth direction. A pinion gear 58 is in meshing engagement with the rack 56. A drive motor 60 and a driving force transmitter 62 are provided inside the case 12. The driving force transmitter 62 includes a plurality of gears. The driving force transmitter 62 transmits the driving force of the drive motor 60 to the pinion gear 58. Therefore, the pinion gear 58 rotates when the drive motor 60 rotates. This causes a change in the relative position of the rack 56 and the pinion gear 58. Due to the change in the relative position, the medium receiving tray 28 moves in the printer depth direction.

As illustrated in FIGS. 5, 6, and 7, a detector 64 is provided over the medium receiving tray 28 inside the case 12. The detector 64 includes a sensor 64*a* and a lever 64*b*. The lever 64*b* is pivotally attached to the sensor 64*a*. The lever 64*b* functions as a switch for switching between a detected state and a non-detected state depending on its positional orientation in relation to the sensor 64*a* in the detector 64.

When the medium receiving tray 28 is located at the first position, the lever 64*b* is in contact with the flat plate portion 28*a* of the medium receiving tray 28 and is lifted toward the sensor 64*a* by the flat plate portion 28*a* in the printer height direction. The detector 64 is in a non-detected state at this point in time. When the medium receiving tray 28 moves frontward in the printer depth direction by receiving the driving force of the drive motor 60, as illustrated in FIG. 7, the lever 64*b* slides off the flat plate portion 28*a* at the rear end 28*c* of the flat plate portion 28*a* in the printer depth direction to rotate away from the sensor 64*a*. As a result, the detector 64 detects the protrusion of the medium receiving tray 28 frontward beyond the front of the case 12 (i.e., detected state).

The position of the medium receiving tray 28 in the printer depth direction in FIGS. 7 and 13 is the position at which the detector 64 detects the protrusion of the medium receiving tray 28 frontward beyond the front of the case 12. In this specification, this position is defined as a third position. In the printer depth direction, the third position of the medium receiving tray 28 is located between the first position and the second position before the second position. In the present embodiment, the protrusion amount of the medium receiving tray 28 when the medium receiving tray 28 is located at the third position is set to be large enough to be able to receive the ejected medium.

Next, with reference to FIGS. 5 and 8, a guided portion 28*d* will now be explained. The guided portion 28*d* is provided on each of two side edges near the rear end 28*c* of the flat plate portion 28*a* of the medium receiving tray 28. Specifically, the guided portion 28*d* extends in the printer depth direction on each of two side edges near the rear end 28*c* of the flat plate portion 28*a*. The guided portion 28*d* includes an upstream portion 28*e* and a downstream portion 28*f*. As illustrated in FIG. 8, in the guided portion 28*d*, the thickness t1 of the upstream portion 28*e* (see FIG. 12) is greater than the thickness t2 of the downstream portion 28*f* (see FIG. 12). In the present embodiment, the upstream side in the operation direction of the medium receiving tray 28 is set to be the rear in the printer depth direction, and the downstream side in the operation direction of the medium receiving tray 28 is set to be the front in the printer depth direction.

Guide

As illustrated in FIGS. 9 and 10, the medium receiving tray 28 is supported by a right frame 66 and a left frame 68, which are constituents of the case 12. Each of the right frame 66 and the left frame 68 has a guide 70 and a supporting surface 72. The guided portion 28*d* of the medium receiving tray 28 is accommodated in the space of the guide 70. The guide 70 guides the medium receiving tray 28 during a change in position in the printer depth direction. The guide 70 of the right frame 60 and the guided portion 28*d* will now be explained.

As illustrated in FIG. 10, the supporting surface 72 of the right frame 66 supports a supported portion 28*g*, which is the underside of the medium receiving tray 28. The supported portion 28*g*, the underside of the medium receiving tray 28, extends in the printer depth direction. The supporting surface 72 of the right frame 66 also extends in the printer depth direction. The supported portion 28*g* slides on the supporting surface 72 when the medium receiving tray 28 changes its position in the printer depth direction. The guided portion 28*d* is not in contact with the supporting surface 72.

As illustrated in FIG. 11, the guide 70 extends in the printer depth direction and is able to guide the movement of the guided portion 28*d* in the printer depth direction during the movement of the medium receiving tray 28 from the first position to the second position. The guide 70 has a first guide area S1 and a second guide area S2 in the printer depth direction.

With reference to FIG. 12, the first guide area S1 will now be explained. The first guide area S1 is for guiding the guided portion 28*d* between the first position and the third position of the medium receiving tray 28. In the first guide area S1, the guide 70 includes an upper guide 70*a* and a lower guide 70*b*.

Let t1 be the thickness of the upstream portion 28*e* of the guided portion 28*d*. Let t2 be the thickness of the downstream portion 28*f* of the guided portion 28*d*. Let L1 be the gap between the upstream portion 28*e* and the upper guide 70*a*. Let L2 be the gap between the downstream portion 28*f* and the upper guide 70*a*. A relation of L1<L2 holds between the gap L1 and the gap L2. The gap L1 is set to be large enough so that the medium receiving tray 28 can move smoothly in the first guide area S1. There is a gap L3 between the guided portion 28*d* and the lower guide 70*b*.

Therefore, when the medium receiving tray 28 moves from the first position toward the second position, in the first guide area S1, the upper guide 70*a* and the lower guide 70*b* do not interfere with the guided portion 28*d* and do not obstruct the movement of the guided portion 28*d*. This ensures smooth movement of the medium receiving tray 28. The gap L3 between the guided portion 28*d* and the lower guide 70*b* remains unchanged at the third position from said gap at the first position of the medium receiving tray 28. That is, the guided portion 28*d* is kept not in contact with the lower guide 70*b*. However, the illustrated structure may be modified by eliminating the gap L3 (L3: zero). That is, the guided portion 28*d* may be in contact with the lower guide 70*b*.

Since the upper guide 70*a* is located over the guided portion 28*d* in the first guide area S1, the upward movement of the medium receiving tray 28 in the printer height direction in excess of the gap L1 is not allowed.

Next, with reference to FIGS. 13 to 16, the second guide area S2 will now be explained. In FIG. 16, the vertical-to-horizontal ratio is altered from that of FIG. 15 to illustrate sloped surfaces 74 and 76 in a narrowing area S3 in a highlighted manner for easier understanding. When the medium receiving tray 28 moves from the first position (see FIG. 3) toward the second position (see FIG. 4), the protrusion of the medium receiving tray 28 from the case 12 is detected by the detector 64 at the third position (see FIG. 13).

As illustrated in FIGS. 14, 15, and 16, the second guide area S2 is set as an area in the guide 70 from the position corresponding to the third position of the medium receiving tray 28 to the position corresponding to the second position of the medium receiving tray 28. The second guide area S2 includes a narrowing area S3 for making the movement path of the upstream portion 28*e* and the downstream portion 28*f* of the guided portion 28*d* narrower than the movement path in the first guide area S1.

Specifically, the narrowing area S3 has a structure for making the movement path of the guided portion 28*d* narrower in a terraced manner as viewed from the rear (upstream side) toward the front in the printer depth direction (downstream side). More specifically, the narrowing area S3 includes a first narrowing area S4 and a second narrowing area S5.

The guide 70 includes an upper guide 70*c* and the lower guide 70*b* in the first narrowing area S4 extending in the printer depth direction. The rear end of the upper guide 70*c* in the printer width direction has a sloped surface 74 (see FIG. 16). The surface 74 slopes down in the printer height direction toward the front of the printer.

The second narrowing area S5 is located at the front position in relation to the first narrowing area S4 in the printer depth direction. The guide 70 includes an upper guide 70*d* and the lower guide 70*b* in the second narrowing area S5 extending in the printer depth direction. The rear end of the upper guide 70*d* in the printer width direction has a sloped surface 76 (see FIG. 16). The surface 76 slopes down in the printer height direction toward the front of the printer.

Let L4 be the gap between the upper guide 70*c* and the downstream portion 28*f*, as illustrated in FIG. 16, when the guided portion 28*d* is located at the second position. Let L5 be the gap between the upper guide 70*d* and the downstream portion 28*f* when the guided portion 28*d* is located at the second position. Let L6 be the gap between the upper guide 70*c* and the upstream portion 28*e* when the guided portion 28*d* is located at the second position. The area denoted as S6 in FIGS. 14, 15, and 16 represents, in the first narrowing area S4, a narrowing area for the upstream portion 28*e* during a change of the upstream portion 28*e* from the third position to the second position.

When the medium receiving tray 28 moves from the first position to the second position, the gap between the upper guide 70*a*, 70*c*, 70*d* and the downstream portion 28*f* of the guided portion 28*d* changes sequentially in the order of L2→L4→L5. A relation of L2>L4>L5 holds among the gaps L2, L4, and L5. That is, the gap between the upper guide 70*a*, 70*c*, 70*d* and the downstream portion 28*f* decreases as the medium receiving tray 28 moves from the first position to the second position.

In addition, there is a change from the gap L1 between the upstream portion 28*e* and the upper guide 70*a* into the gap L6 between the upstream portion 28*e* and the upper guide 70*c* when the medium receiving tray 28 moves from the first position to the second position. A relation of L1>L6 holds between the gap L1 and the gap L6. That is, the gap between the upper guide 70*a*, 70*c* and the upstream portion 28*e* also decreases as the medium receiving tray 28 moves from the first position to the second position.

In other words, as the medium receiving tray 28 moves from the first position toward the second position, the gap between the guide 70*a*, 70*c*, 70*d*, which is located over the guided portion 28*d*, and the guided portion 28*d* decreases. Therefore, the movement of the guided portion 28*d* in the printer height direction is more restricted when the medium receiving tray 28 is located at the second position as compared with when the medium receiving tray 28 is located at the first position.

In particular, in the present embodiment, the gap L5 is set to be substantially zero so that the downstream portion 28*f* will come into contact with the upper guide 70*d*, and the gap L6 is also set to be substantially zero so that the upstream portion 28*e* will come into contact with the upper guide 70*c*. Therefore, when the medium receiving tray 28 is located at the second position, the upward movement of the upstream portion 28*e* and the downstream portion 28*f* of the guided portion 28*d* in the printer height direction is restricted. Though each of the gaps L5 and L6 is set to be substantially zero in the present embodiment, the scope of the disclosure is not limited thereto. The set value of the gap L5, L6 may be any value that is able to reduce the vibration of the medium receiving tray 28 at the second position.

With reference to FIGS. 11, 12, 14, 15, and 16 again, the relationship between the guided portion 28*d* and the guide 70 will now be further described for a brief summary. When the medium receiving tray 28 is located at the first position, as illustrated in FIGS. 11 and 12, both the upstream portion 28*e* and the downstream portion 28*f* of the guided portion 28*d* are located inside the first guide area S1 in the printer depth direction. Since the gap L1 between the upper guide 70*a* and the upstream portion 28*e* in the first guide area S1 is set to be large enough so as not to obstruct the movement of the guided portion 28*d* in the printer depth direction, it is possible to suppress a load against the movement of the guided portion 28*d* in the first guide area S1, meaning that the movement is smooth.

Next, as illustrated in FIG. 14, when the medium receiving tray 28 moves from the first position to the third position, the downstream portion 28*f* of the guided portion 28*d* goes into the first narrowing area S4 of the second guide area S2 from the first guide area S1. Therefore, the guide over the downstream portion 28*f* switches from the upper guide 70*a* to the upper guide 70*c*. As a result, the gap between the downstream portion 28*f* and the upper guide decreases.

When the medium receiving tray 28 moves from the third position to the second position, as illustrated in FIGS. 15 and 16, the upstream portion 28*e* of the guided portion 28*d* goes into the narrowing area S6 of the first narrowing area S4 of the second guide area S2 from the first guide area S1, and the downstream portion 28*f* goes into the second narrowing area S5 from the first narrowing area S4.

Therefore, the upstream portion 28*e* comes into contact with the upper guide 70*c*, and the downstream portion 28*f* comes into contact with the upper guide 70*d*. As a result, the movement of the guided portion 28*d* in the printer height direction is restricted.

Suppose that an external force is applied in the printer height direction to the raised portion 28*b*, which is the front end portion of the medium receiving tray 28. If the portion where the external force is applied in the medium receiving tray 28 (front end portion) is defined as the point of effort, the fulcrum and the point of motion are located at the rear side in the medium receiving tray 28 in the printer depth direction. The movement, in the printer height direction, of the upstream portion 28*e* and the downstream portion 28*f* of the guided portion 28*d* located at the rear side in the medium receiving tray 28 in the printer depth direction is restricted by the guide 70. Because of restriction on the movement of the fulcrum portion and the point-of-motion portion in the medium receiving tray 28 in the printer height direction, it is possible to suppress the vibration of the medium receiving tray 28.

In the present embodiment, the third position of the medium receiving tray 28 is set to be just before the second position to ensure that the distance of movement from the third position to the second position is short. The third position, at which the detector 64 detects the medium receiving tray 28, is located near the second position, at which the medium receiving tray 28 receives a medium. Therefore, even in a case where the medium receiving tray 28 is unable to reach the second position for some reason or other, the medium receiving tray 28 at the third position is able to receive the medium as long as the medium receiving tray 28 is able to move to the third position.

Moreover, since the second position of the medium receiving tray 28 is located near the third position thereof, it is possible to shorten the distance of high-load movement of the medium receiving tray 28, thereby reducing the burden on the drive motor 60. Moreover, the nearness reduces the length of the narrowing area S3 of the second guide area S2 in the guide 70, making it easier to obtain high molding precision in the narrowing area S3.

Furthermore, since the movement path of the guided portion 28*d* of the medium receiving tray 28 is made narrower after the detection of the medium receiving tray 28 by the detector 64, it is possible to reduce an error in the detection of the medium receiving tray 28 by the detector 64.

In the present embodiment, as illustrated in FIG. 4, when the medium receiving tray 28 moves from the first position to the second position, the medium receiving tray 28 advances while pushing the cover 20 out of the way to protrude frontward beyond the front of the case 12. Since the cover 20 is urged in the closing direction by the aforementioned non-illustrated urging member, the cover 20 is in contact with, from below, the medium receiving tray 28 protruding frontward beyond the front of the case 12, thereby applying an upward force in the printer height direction to the medium receiving tray 28. This force acts to further suppress the vibration of the medium receiving tray 28 when external stress is applied to the medium receiving tray 28.

Though the guide 70 of the right frame 66 and the guided portion 28*d* are referred to in the above description, the guide 70 of the left frame 68 has the same structure as that of the guide 70 of the right frame 66.

Variation Examples of First Embodiment (1) The present embodiment has a structure of extending in the printer depth direction to maintain the gap L4 from the downstream portion 28*f* and the gap L5 from the downstream portion 28*f* in the first narrowing area S4 and the second narrowing area S5 respectively. Instead of employing the structure of the embodiment, convex regions that protrude into the space of the guide 70 from the upper guide 70*c* and the upper guide 70*d* or from the lower guide 70*b* at the positions corresponding to the upstream portion 28*e* and the downstream portion 28*f* of the guided portion 28*d* may be provided to nip the guided portion 28*d* when the medium receiving tray 28 arrives at the second position.

(2) In the present embodiment, as the medium receiving tray 28 moves from the first position toward the second position, the gap between the upper guide 70*a*, 70*c*, 70*d*, which is located over the guided portion 28*d*, and the guided portion 28*d* decreases. Instead, the width of the guide 70 in relation to the guided portion 28*d* may be decreased from the first position toward the second position.

Second Embodiment

With reference to FIG. 17, a second embodiment will now be explained. As illustrated in FIG. 17, a weight 78 is mounted on the lower surface of the raised portion 28*b* of the medium receiving tray 28. Since the weight of the front end portion of the medium receiving tray 28 is increased in this structure, when vibration occurs due to external stress applied to the front end portion, it is possible to dampen the vibration and make the time of vibration attenuation shorter.

Third Embodiment

With reference to FIG. 18, a third embodiment will now be explained. In FIG. 18, the guide 70 is equipped with rollers 80A and 80B. The rollers 80A and 80B are urged by urging members 82A and 82B respectively in a direction of protruding into the space of the guide 70. As illustrated in FIG. 18, the rollers 80A and 80B rotate in contact with the upstream portion 28*e* and the downstream portion 28*f* of the guided portion 28*d* when the medium receiving tray 28 moves from the first position to the second position. The rollers 80A and 80B are pressed against the upstream portion 28*e* and the downstream portion 28*f* of the guided portion 28*d* due to the urging forces of the urging members 82A and 82B respectively. Therefore, the guided portion 28*d* is held by the rollers 80A and 80B when an external force is applied to the raised portion 28*b*, which is the front end portion of the medium receiving tray 28, though not illustrated. Consequently, it is possible to reduce the vibration of the medium receiving tray 28.

The foregoing description is summarized as follows. The printer 10 comprises: the case 12, the recording head 46 that is provided inside the case 12 and performs recording on a medium; the medium receiving tray 28 that is able to move for a position change between a first position and a second position, the first position being a position of being housed inside the case 12, the second position being a position of protruding from the case 12 to receive the medium ejected; the guide 70 for guiding the medium receiving tray 28 in a position change direction; and the guided portion 28*d* of the medium receiving tray 28, the guided portion 28*d* being guided by the guide 70, wherein the guide 70 includes a first guide area S1 and a second guide area S2, wherein the first guide area S1 is an area for guiding the guided portion 28*d* during movement of the medium receiving tray 28 from the first position to a third position that is located between the first position and the second position before the second position, wherein the second guide area S2 is an area for guiding the guided portion 28*d* during movement of the medium receiving tray 28 from the third position to the second position, and wherein the second guide area S2 includes a narrowing area S3 for making a movement path of the upstream portion 28*e* and the downstream portion 28*f* of the guided portion 28*d* narrower than the movement path in the first guide area S1.

In the above structure, the guide 70 for guiding the guided portion 28*d* of the medium receiving tray 28 includes the first guide area S1 and the second guide area S2, and the second guide area S2 includes the narrowing area S3 for making the movement path of the upstream portion 28*e* and the downstream portion 28*f* of the guided portion 28*d* narrower than the movement path in the first guide area S1. The movement of the upstream portion 28*e* and the downstream portion 28*f* of the guided portion 28*d* is restricted when the medium receiving tray 28 is located in the second guide area S2. Therefore, it is possible to suppress the vibration of the medium receiving tray 28 effectively.

In addition, since the movement path of the guided portion 28*d* in the first guide area S1 is not narrower than the movement path of the guided portion 28*d* in the second guide area S2, a load against the movement of the guided portion 28*d* is suppressed. Therefore, it is possible to cause the medium receiving tray 28 to operate for a position change properly.

Moreover, since the second guide area S2 includes an area for making the movement path of the upstream portion 28*e* and the downstream portion 28*f* of the guided portion 28*d* narrower, it is unnecessary to uniformly make the movement path of the guided portion 28*d* narrower in the entire second guide area S2. This makes it easier to obtain high molding precision and makes it possible to shorten the distance over which the guided portion 28*d* receives a high load against the movement in the second guide area S2.

The movement of the upstream portion 28*e* and the downstream portion 28*f* of the guided portion 28*d* in the printer height direction, which is the direction of thickness of the medium receiving tray 28, is restricted in the narrowing area S3. With this structure, it is possible to suppress the vibration of the medium receiving tray 28 more effectively.

The upstream portion 28*e* of the guided portion 28*d* is thicker than the downstream portion 28*f* of the guided portion 28*d*; the second guide area S2 has a shape for making the movement path of the guided portion 28*d* narrower in a terraced manner as viewed from an upstream side toward a downstream side; and the movement path of the upstream portion 28*e* and the downstream portion 28*f* of the guided portion 28*d* is made narrower due to the movement of the medium receiving tray 28 from the third position toward the second position. By this means, it is possible to form the second guide area S2 with a simple structure at low cost.

The printer 10 further comprises: the cassette 22 that is a container for the medium and is able to be drawn out of the case 12; wherein the cassette 22 includes the cover 20 that is able to be opened and closed and constitutes at least a part of front of the case 12; and wherein the cover 20 is urged in a closing direction and is able to be in contact with the medium receiving tray 28 from below. Because of the contact of the cover 20 with the medium receiving tray 28, with this structure, it is possible to further suppress the vibration of the medium receiving tray 28 when external stress is applied to the medium receiving tray 28.

The printer 10 further comprises: the detector 64 that detects protrusion of the medium receiving tray 28 from the case 12 at the third position. With this structure, it is possible to detect the protrusion of the medium receiving tray 28 before the timing of the narrowing of the movement path of the guided portion 28*d* when the medium receiving tray 28 protrudes. The detection of the protrusion of the medium receiving tray 28 makes it possible to continue the use of the printer 10 even in a case where the guided portion 28*d* is unable to move in the second guide area S2, that is, the areas S4 and S5 for narrowing the movement path of the guided portion 28*d*, because of, for example, aged deterioration of the guide 70 or the deformation of the guided portion 28*d*.

The printer 10 comprises: the case 12; the recording head 46 that is provided inside the case 12 and performs recording on a medium; the medium receiving tray 28 that is able to move for a position change between a first position and a second position, the first position being a position of being housed inside the case 12, the second position being a position of protruding from the case 12 to receive the medium ejected; the guide 70 for guiding the medium receiving tray 28 in a position change direction; the detector 64 that detects protrusion of the medium receiving tray 28 from the case 12; and the guided portion 28*d* of the medium receiving tray 28, the guided portion 28*d* being guided by the guide 70, wherein the guide 70 includes a first guide area S1 and a second guide area S2, wherein the first guide area S1 is an area for guiding the guided portion 28*d* during movement of the medium receiving tray 28 from the first position to a third position that is located between the first position and the second position before the second position, wherein the second guide area S2 is an area for guiding the guided portion 28*d* during movement of the medium receiving tray 28 from the third position to the second position, wherein the second guide area S2 includes a narrowing area S3 for making a movement path of the guided portion 28*d* narrower than the movement path in the first guide area S1, and wherein the detector 64 detects the protrusion of the medium receiving tray 28 from the case 12 at the third position.

In the above structure, the guide 70 for guiding the guided portion 28*d* of the medium receiving tray 28 includes the first guide area S1 and the second guide area S2, and the second guide area S2 includes the narrowing area S3 for making the movement path of the guided portion 28*d* narrower than the movement path in the first guide area S1. The movement of the guided portion 28*d* is restricted when the medium receiving tray 28 is located in the second guide area S2. Therefore, it is possible to suppress the vibration of the medium receiving tray 28. In addition, since the movement path of the guided portion 28*d* in the first guide area S1 is not narrower than the movement path of the guided portion 28*d* in the second guide area S2, a load against the movement of the guided portion 28*d* is suppressed. Therefore, it is possible to cause the medium receiving tray 28 to operate for a position change properly.

Moreover, since the printer 10 comprises the detector 64 that detects protrusion of the medium receiving tray 28 from the case 12 at the third position, it is possible to detect the protrusion of the medium receiving tray 28 before the timing of the narrowing of the movement path of the guided portion 28*d* when the medium receiving tray 28 protrudes. The detection of the protrusion of the medium receiving tray 28 makes it possible to continue the use of the printer 10 even in a case where the guided portion 28*d* is unable to move in the second guide area S2, that is, the areas S4 and S5 for narrowing the movement path of the guided portion 28*d*, because of, for example, aged deterioration of the guide 70 or the deformation of the guided portion 28*d*.

In the embodiments described above, the guided portion 28*d* and the guide 70 are applied to an ink-jet printer that is an example of a recording apparatus. However, they may be applied to other various kinds of a liquid ejecting apparatus. The term "liquid ejecting apparatus" includes, but not limited to, a recording apparatus such as a printer, a copier, and a facsimile, etc. that includes an ink-jet recording head and performs recording by ejecting ink onto a recording target medium from the head. It further encompasses a variety of apparatuses that ejects, in place of ink, liquid used in its specific application from a liquid ejecting head corresponding to an ink-jet recording head onto a liquid ejection target medium corresponding to a recording target medium so as to put the liquid onto the medium.

Examples of a liquid ejecting head are: a recording head mentioned above, a color material ejection head used in the production of a color filter for a liquid crystal display, etc.; an electrode material (i.e., conductive paste) ejection head used for the electrode formation of an organic EL display device, a surface/plane emission display (FED), etc.; a living organic material ejection head used for production of biochips; and a sample ejection head that functions as a high precision pipette.

The scope of the invention is not limited to the foregoing embodiments. It may be modified, altered, changed, adapted, and/or improved within the scope of the recitation of appended claims. Needless to say, such a modification, etc. is also within the scope of the invention.

What is claimed is:

1. A recording apparatus, comprising:

a housing;

a recording device that is provided inside the housing and performs recording on a medium;

a medium receiving tray that is able to move for a position change between a first position and a second position, the first position being a position of being housed inside the housing, the second position being a position of protruding from the housing to receive the medium ejected;

a guide for guiding the medium receiving tray in a position change direction; and a guided portion of the medium receiving tray being guided by the guide, wherein the guide includes a first guide area and a second guide area, wherein the first guide area is an area for guiding the guided portion during movement of the medium receiving tray from the first position to a third position that is located between the first position and the second position before the second position, wherein the second guide area is an area for guiding the guided portion during movement of the medium receiving tray from the third position to the second position, and wherein the second guide area includes a narrowing area for making a movement path of an upstream portion and a downstream portion of the guided portion narrower than the movement path in the first guide area.

2. The recording apparatus according to claim 1, wherein movement of the upstream portion and the downstream portion of the guided portion in a direction of thickness of the medium receiving tray is restricted in the narrowing area.

3. The recording apparatus according to claim 2, wherein the upstream portion of the guided portion is thicker than the downstream portion of the guided portion;

wherein the second guide area has a shape for making the movement path of the guided portion narrower in a terraced manner as viewed from an upstream side toward a downstream side; and wherein the movement path of the upstream portion and the downstream portion of the guided portion is made narrower due to the movement of the medium receiving tray from the third position toward the second position.

4. The recording apparatus according to claim 1, further comprising:

a cassette that is a container for the medium and is able to be drawn out of the housing;

wherein the cassette includes a cover that is able to be opened and closed and constitutes at least a part of front of the housing; and wherein the cover is urged in a closing direction and is able to be in contact with the medium receiving tray from below.

5. The recording apparatus according to claim 1, further comprising:

a detector that detects protrusion of the medium receiving tray from the housing at the third position.

6. A recording apparatus, comprising:

a housing;

a recording device that is provided inside the housing and performs recording on a medium;

a medium receiving tray that is able to move for a position change between a first position and a second position, the first position being a position of being housed inside the housing, the second position being a position of protruding from the housing to receive the medium ejected;

a guide for guiding the medium receiving tray in a position change direction;

a detector that detects protrusion of the medium receiving tray from the housing; and a guided portion of the medium receiving tray being guided by the guide, wherein the guide includes a first guide area and a second guide area, wherein the first guide area is an area for guiding the guided portion during movement of the medium receiving tray from the first position to a third position that is located between the first position and the second position before the second position, wherein the second guide area is an area for guiding the guided portion during movement of the medium receiving tray from the third position to the second position, wherein the second guide area includes a narrowing area for making a movement path of the guided portion narrower than the movement path in the first guide area, and wherein the detector detects the protrusion of the medium receiving tray from the housing at the third position.

* * * * *